US006533272B2

(12) United States Patent
Hylak et al.

(10) Patent No.: US 6,533,272 B2
(45) Date of Patent: Mar. 18, 2003

(54) BASEBALL GAME APPARATUS

(75) Inventors: Peter Hylak, McKinney, TX (US); Jason Marshall, Bellwood, IL (US); Lyle Williman, Glendale Heights, IL (US)

(73) Assignee: Regent Sports Corporation, Hauppauge, NY (US)

( * ) Notice: Subject to any disclaimer, the term of this patent is extended or adjusted under 35 U.S.C. 154(b) by 0 days.

(21) Appl. No.: 09/725,644

(22) Filed: Nov. 29, 2000

(65) Prior Publication Data

US 2002/0063385 A1 May 30, 2002

(51) Int. Cl.[7] ..... A63F 7/07; A63F 7/22

(52) U.S. Cl. ..... 273/108.31; 273/108.32; 273/108.52; 273/108.56; 273/119 R; 273/121 R; 273/125 R

(58) Field of Search ..... 273/108.3, 108.31, 273/108.32, 108.33, 108.51, 108.53, 119 R, 129 V, 129 W, 317.6, 317.7, 317.8, 317.9, 108.52, 108.54, 259, 244.1, 123 R, 120 R, 120 A, 121 R, 122 R; 463/1, 3, 4

(56) References Cited

U.S. PATENT DOCUMENTS 1,048,047 A * 12/1912 Curtis
1,298,591 A * 3/1919 Smith
1,973,820 A * 9/1934 MacDougall
2,161,129 A * 6/1939 Brook
2,276,457 A * 3/1942 Bock
3,009,452 A 11/1961 Barber et al. ..... 124/27
3,355,173 A 11/1967 Selker ..... 273/89
3,358,997 A * 12/1967 Belz
3,381,961 A 5/1968 Wright ..... 273/90
3,525,525 A 8/1970 Rideout ..... 273/89
3,534,962 A 10/1970 Singleman ..... 273/90
3,705,723 A 12/1972 Eissler ..... 273/89
3,706,454 A 12/1972 Parlato ..... 273/89
3,730,525 A 5/1973 Maeda ..... 273/89
3,814,425 A * 6/1974 Kanefield
3,854,720 A 12/1974 Duvall ..... 273/89
3,879,037 A 4/1975 Cooke ..... 273/89
3,883,139 A 5/1975 Morrison ..... 273/89
4,017,074 A 4/1977 Roberts ..... 273/89
4,179,123 A * 12/1979 Tsukuda
4,195,838 A * 4/1980 Santandrea
4,216,961 A 8/1980 McQuillan ..... 273/89
4,327,913 A 5/1982 Bock ..... 273/89
4,519,610 A 5/1985 Kallio ..... 273/89
4,877,244 A 10/1989 Burrows et al. ..... 273/89
4,976,434 A 12/1990 Wikner ..... 273/85
5,125,658 A 6/1992 Francis et al. ..... 273/89
5,183,266 A * 2/1993 Kohler
5,409,221 A 4/1995 Cohn ..... 273/89
5,443,262 A 8/1995 Weng ..... 273/89
6,032,954 A 3/2000 Fotter ..... 273/108.3

* cited by examiner

*Primary Examiner*—Sebastiano Passaniti
(74) *Attorney, Agent, or Firm*—Darby & Darby

(57) ABSTRACT

The present invention provides a simulated baseball game apparatus. The game is played generally in accordance with the rules of actual baseball. The apparatus resembles a baseball field and is designed to be played by at least two players. An offensive player attempts to the hit the ball using a batting mechanism, while a defensive player pitches and fields the ball using pitching and fielding mechanisms, respectively.

39 Claims, 17 Drawing Sheets

BASEBALL GAME APPARATUS

TECHNICAL FIELD

This invention relates generally to games and more specifically, to a mechanical baseball game which simulates a real baseball game and is played on a playing surface by players on opposing sides.

BACKGROUND OF THE INVENTION

Numerous board games have been developed over the years and serve not only to provide entertainment and challenge to one or more players but are also designed to simulate games which are well known to the player(s). One such game is the game of baseball. Because of the popularity of the game of baseball, a number of board games and the like have been developed to simulate the game of baseball in a board game setting.

The game of baseball involves two teams each having nine players with the teams alternating between offensive play and defensive play. The team that is playing offense has each of its players attempt to hit a baseball with a bat thrown by a pitcher, positioned at a pitcher's mound, toward home plate where the batter stands. The pitcher is one of the defensive players. Depending upon the location of the thrown baseball relative to the hitter and home plate, the pitch may be considered a ball or strike or may be hit by the batter if contact is made. Each offensive player is only permitted only three strikes before being called out. The offensive player will also be considered out if a hit baseball is caught by a defensive player whether the catch occurs within the playing field or in foul territory. The batter will also be considered out if the batter fails to make it to a respective base before the ball is thrown to the player at that respective base. Runs are typically scored by batters hitting singles, doubles, triples, and home runs which enable the batters to run from one base to the next and eventually to home plate to record the run.

Many of the first attempts at developing a simulated baseball game provided a baseball playing field depicted on a game board. This type of game is designed for two players, one of which is at bat and the other of which is in the field. The game is essentially played using dice having indicia displayed on each die. One die represents a batter die and has indicia which represents various hit possibilities and the other die represents a fielding die and has indicia which show various out possibilities. For example, the batter die may include representations of a strike, a ball, a foul ball, or a hit. The die preferably has a sufficient number of faces which permit the various hit possibilities, e.g., single, double, triple, and home run, to be included on the die. In this case, the type of hit is determined by how the die rests after the player throws the die. Alternatively, a separate die may be used to determine the type of hit if the first die thrown indicates that a hit has potentially been accomplished.

The fielding die similarly lists various fielding possibilities, including but not limited to the ball being caught, dropped, or no play by the fielder. For example, when the die indicates that the fielder either dropped or did not make a play, the hitter is awarded the number of bases indicated on the batter die. Various game pieces are moved around the simulated baseball diamond to represent players on base. The game essentially follows the rules of baseball in that the offensive player seeks to score as many runs as possible and the defensive player seeks to register three outs with as few runs being scored by the offensive player. In place of dice, spinners may be used so that each player spins a pointer which points to one of the indicia printed on the spinner.

One main disadvantage of this type of game is that it fails to truly simulate or represent the actual playing conditions of baseball. That is to say that the throwing of dice or spinning a spinner does not bear any relation to the motor skills involved in a baseball contest. These skills including pitching the baseball such that the batter is not able to register hits and hitting the baseball to score runs.

To overcome these disadvantages, simulated baseball games advanced from the board game format to a game in which one player actually pitches a miniature baseball to a batter. More specifically, the defensive player manipulates a pitching mechanism which projects the miniature baseball toward home plate. The offensive player at bat manipulates a bat mechanism at home plate and attempts to strike and drive the baseball into the playing field. Dispersed throughout the playing field are a number of openings into which a hit ball can drop to represent various out and hit possibilities.

This type of game has definite advantages over games using dice and spinners because the outcome of the game is determined somewhat by the motor skills of the two players rather than simply being determined by the laws of chance. Despite the advances, the game still lacks certain elements which prevent the game from achieving the realism of an actual baseball game, because many game options and possibilities that contribute to the game of baseball are not included. In addition, this type of game does not include a fielding mechanism which permits the defensive player to attempt to register an out even though the offensive player hit the baseball into the playing field. As any fan of baseball knows, fielding is an important and exciting aspect of the game because it permits the defensive player to register an out after the batter has contacted and hit the baseball into play.

Thus there is a need for a simulated baseball game apparatus which has features and components that make the game more similar to the sport of baseball. For example, it is desirable for the game to include a pitching mechanism which permits the defensive player to select a type of pitch to be thrown to the batter and also it would be advantageous for the game to include some type of fielding mechanism which permits the defensive player to attempt to register an out after the ball has been hit by a batter.

SUMMARY OF INVENTION

The present invention provides a game apparatus which permits two or more opposing players to play a simulated game of baseball. The game is played on a field which resembles a traditional baseball diamond and outfield. One player (the defensive player) controls the pitching of a ball using a pitching mechanism that permits the defensive player to select from a number of different types of pitches (e.g., curve, back-up, and overspin). This allows the defensive player to vary the type of pitches which are thrown to the offensive player at bat. The speed of the pitch is also variably controlled by the defensive player. Similarly, the offensive player controls the offensive aspects of the game by being able to control the timing and speed of the swing of a bat which is part of a batting mechanism. The game apparatus also includes a plurality of hit valuation indicators which are disposed throughout the game field at select locations. Base hits and other events are recorded by activating one of these hit valuation indicators. Upon activating one of the indicators, the offensive player is awarded the associated value of the indicator.

According to the present invention, a fielding mechanism is provided by which the defensive player may catch a hit ball to record an out as in the game of baseball. The fielding mechanism is displaceable across an upper surface of the field for recording an out after the ball has been hit. The fielding mechanism includes members for receiving and retaining the hit ball so that one player may record the out by positioning one of the members so that the hit ball is caught and retained by the member. The fielding mechanism thus permits the defensive player to control not only the pitching aspects of the game but also the fielding aspects.

Other features and advantages of the present invention will be apparent from the following detailed description when read in conjunction with the accompanying drawings.

BRIEF DESCRIPTION OF THE DRAWINGS

The foregoing and other features of the present invention will be more readily apparent from the following detailed description and drawings of an illustrative embodiment of the invention in which.

DETAILED DESCRIPTION OF THE PREFERRED EMBODIMENTS

Figure 1:
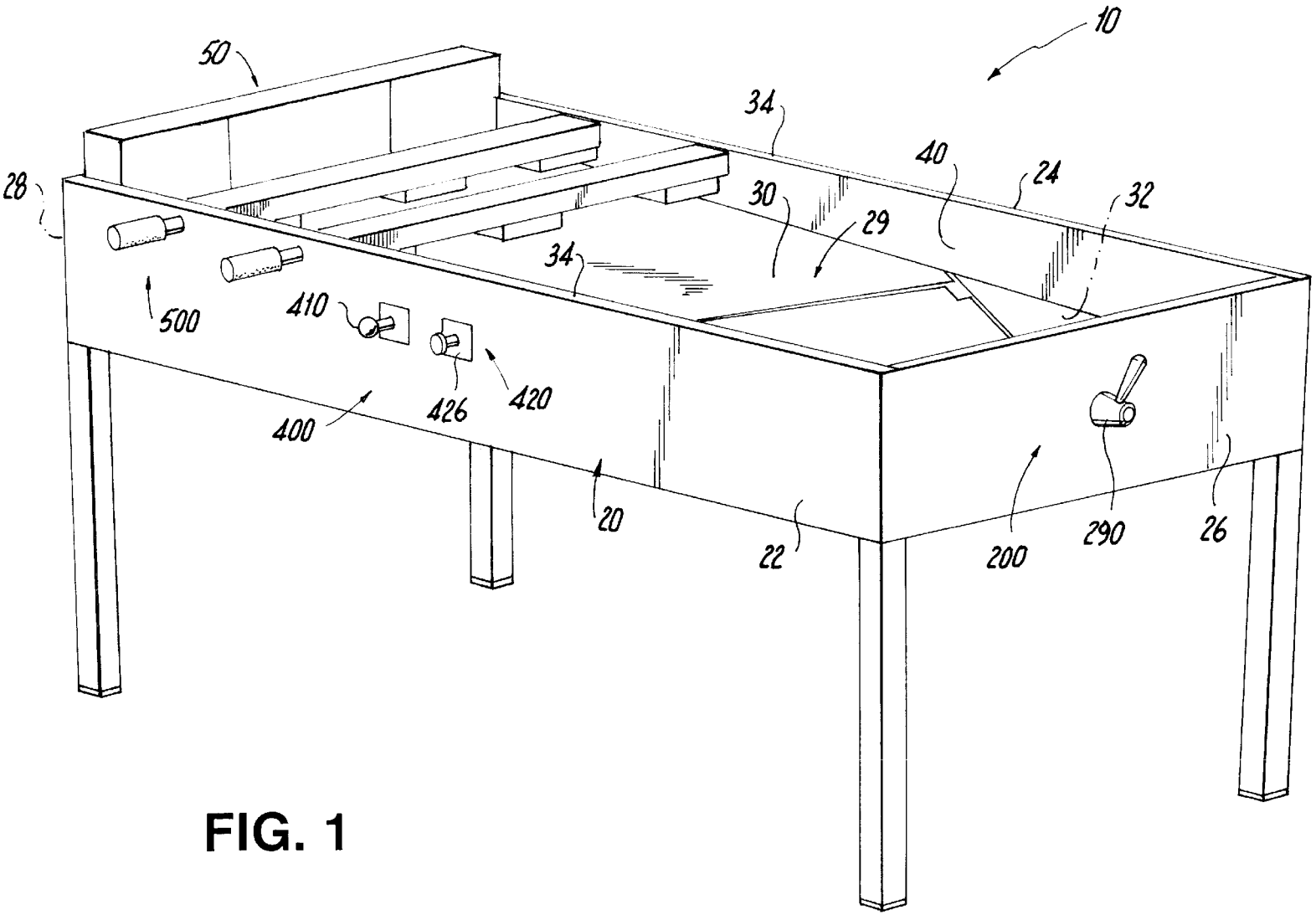
FIG. 1 is a perspective view of a simulated game playing apparatus according to one exemplary embodiment of the present invention.
Figure 2:
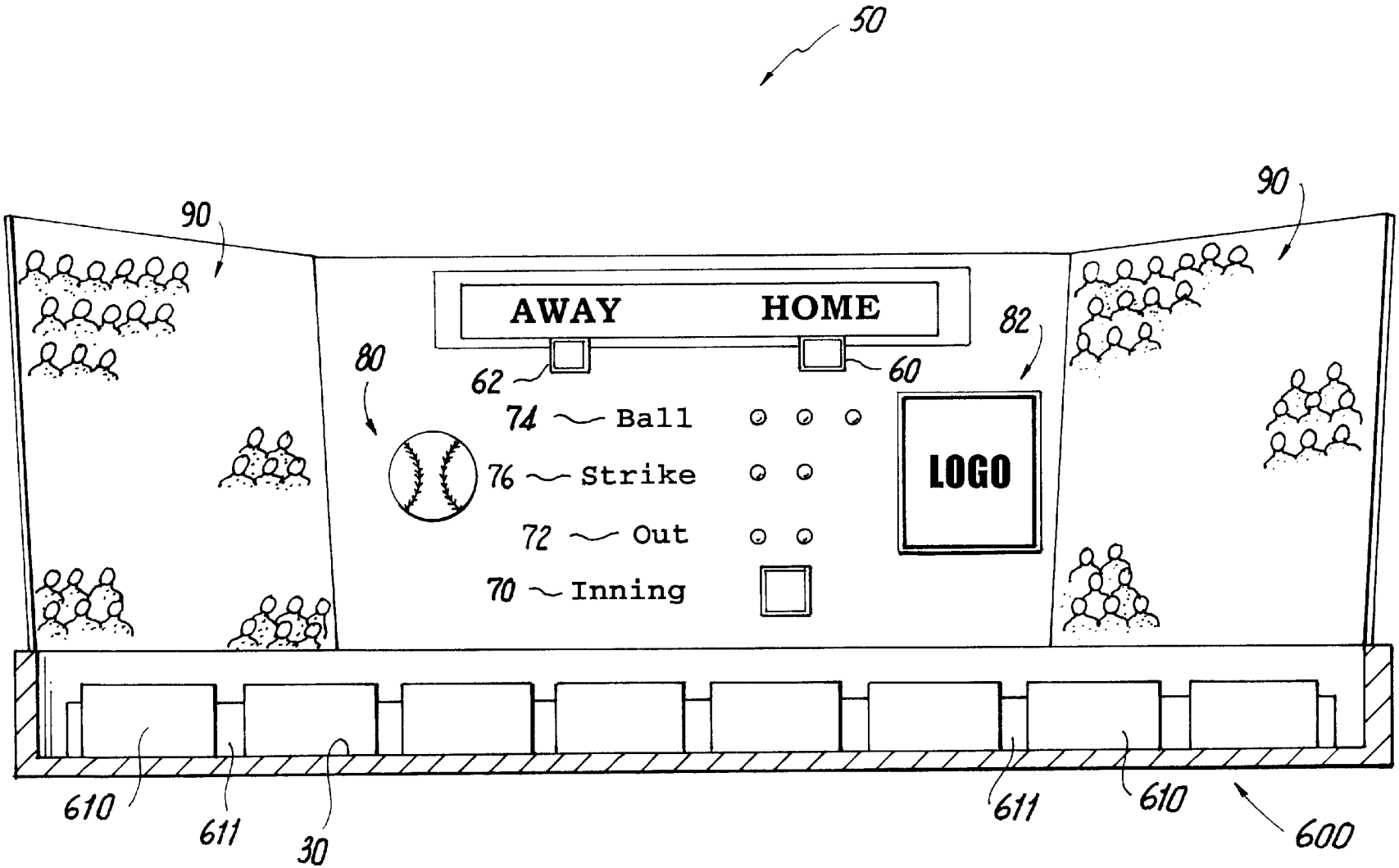
FIG. 2 is a front view of one exemplary scoring device employed in the apparatus of FIG. 1.
Figure 3:
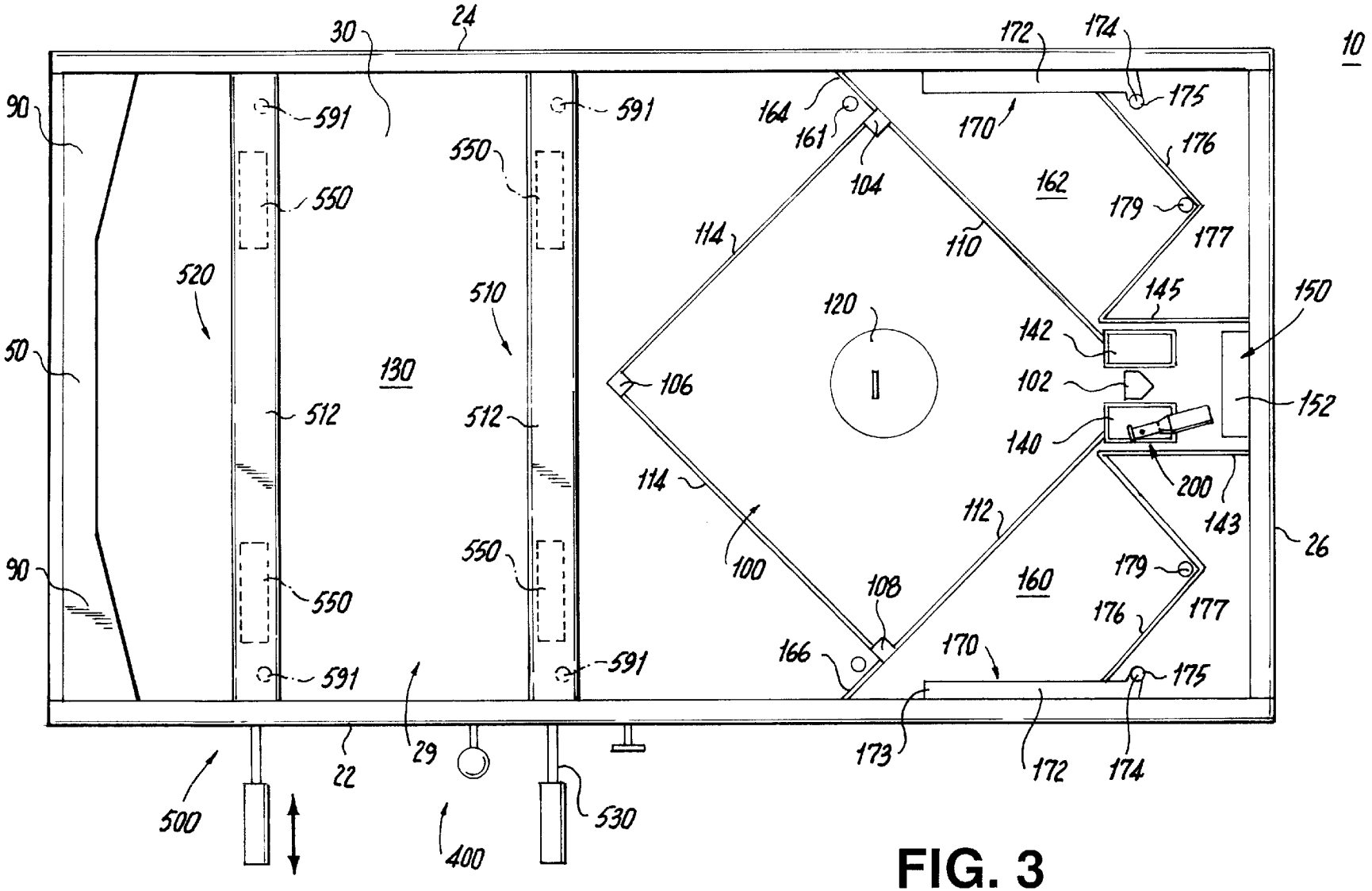
FIG. 3 is a top plan view of one exemplary playing surface.

Referring now to FIGS. 1–3, a simulated baseball apparatus according to one embodiment of the present invention is generally indicated at 10. The game apparatus 10 provides a baseball game for play by two or more players. Following the rules of baseball, the players take turns in the field and at bat. One player (the defensive player) pitches a miniature ball (not shown) to the other player (the offensive player) using a pitching mechanism 400. The pitching mechanism 400 of the present invention permits the defensive player to control the type of pitch (e.g., curve, back-up, and overspin) thrown to the offensive player and also permits control over the speed of the pitch. The offensive player attempts to hit the ball using a batting mechanism 200. Once the ball has been hit, the defensive player manipulates a fielding mechanism 500 which is designed to permit the defensive player to "catch" the hit ball to thereby record an out. After an out is recorded or the offensive player safely reaches base, the ball is returned to the pitching mechanism 400 using a ball retrieval track system 300 (FIGS. 17 and 18) so that the defensive player may pitch the ball again to the offensive player. Advantageously, the game apparatus 10 provides an entertaining and realistic game for two or more players.

The apparatus 10 includes a generally rectangular housing 20 formed of opposing first and second side walls 22, 24 with first and second end walls 26, 28 extending therebetween. The housing 20 also includes a playing field 29 having a top surface 30 and an opposing bottom surface 32 which faces the ground floor when the apparatus 10 is properly positioned for use. The playing field 29 extends generally between the first and second side walls 22, 24 and the first and second end walls 26, 28. The playing field 29 is inclined relative to the first and second side walls 22, 24 and the first and second end walls 26, 28 so that the top surface 30 has a predetermined pitch. The top surface 30 is recessed relative to a top edge 34 of each of the first and second side walls 22, 24 so that an upper section, generally indicated at 40, of the first and second side walls 22, 24 and first and second end walls 26, 28 extends above the top surface 30 around a periphery of the apparatus 10. As best shown in FIG. 1, this upper section 40 may be used to display various indicia.

The game apparatus 10 also has a scoreboard device 50 which is positioned at or proximate to the second end wall 28 of the apparatus 10. The scoreboard device 50 generally extends in a vertical direction upward from the top edge 34 of the second end wall 28 and is therefore generally perpendicular to the top surface 30. At a minimum, the scoreboard device 50 includes means for indicating the number of runs of the home team and the number of runs for the visiting team. When the scoreboard device 50 is mechanically operated, the number of runs for each team may be indicated using any number of techniques. For example, a first dial (not shown) may be rotatably mounted beneath the scoreboard device 50 to indicate the home team's runs and a second dial (not shown) may be rotatably mounted for indicating the visiting team's runs. Each of the dials contains a serrated edge which protrudes through slots (not shown) in the scoreboard device 50 such that they may be manually rotated, Each dial contains indicia thereon which appears through corresponding square cutouts (not shown) formed in the scoreboard device 50.

While a mechanically operated system is suitable for use in the game apparatus 10, it is preferred that the scoreboard device 50 comprises an electronically operated system. Once again, at a minimum, the scoreboard device 50 has a first window 60 formed therein for indicating the number of runs for the home team and a second window 62 for indicating the number of runs for the visiting team. Each window 60, 62 is preferably an LED or LCD based window such that the number of runs is indicated by illuminating the LED or LCD in the respective window 60, 62.

It is also expected that the scoreboard device 50 will include a number of other baseball related indicators. For example, the scoreboard device 50 preferably includes a first indicator 70 for indicating the number of innings which have been played and a second indicator 72 for indicating the number of outs at any given point of time. The pitch count is also preferably illustrated by having a third indicator 74 for indicating the number of balls and a fourth indicator 76 for indicating the number of strikes. Preferably, these indicators 70, 72, 74, 76 are also electronically based such that an LED is illuminated for indicating the respective information. While, the first indicator 70 preferably indicates the inning in numerical form, the second, third, and fourth indicators 72, 74, 76 may comprise a number of circular openings formed in the scoreboard device 50 with each circular opening having an LED disposed therein. For example, the second indicator 72 will have two circular openings, the third indicator 74 will have three circular openings, and the fourth indicator 76 will have two circular openings. As an event occurs, one of the respective circular openings of the respective indicator is illuminated to conveniently display the status of the game. For example, when a ball is registered, the next available lowermost circular opening of the third indicator 74 is illuminated.

It will be appreciated that the scoreboard device 50 may also include other indicators and displays. In the exemplary embodiment, the scoreboard device 50 has a first display section 80 at one end of the device 50 and a second display section 82 at the opposite end of the device 50. Any number of items or information may be displayed at either of these first and second display sections 80, 82. For example, the first display section 80 shown in FIG. 1 includes a graphic depiction of a baseball to further convey that the simulated game apparatus 10 is a simulated baseball game. The second display section 82 may be used to display a variety of information. In one exemplary embodiment, the second display section 82 lists the proprietary name of the manufacturer of the game apparatus 10 and also includes other messages, such as advertising, or other indicia.

The first and second display sections 80, 82 may be permanently formed on the scoreboard device 50. In this instance, individual displays may be fixed to the sections 80, 82 by printing the displays thereon or may be adhered using other means such as an adhesive. It will also be appreciated that either or both of the first and second display sections 80, 82 may include computer generated graphics displayed on an LCD or CRT.

When the first and second display sections 80, 82 are not electronically-based, each display may also include means for removably applying the individual display within the respective first or second display section 80, 82. For example, the display may have a magnetic backing which permits the individual display to be removably attached to one of the sections 80, 82 so long as a sufficient portion of the sections 80, 82 is formed of a material which is magnetic.

The scoreboard device 50 may also be equipped with sound generating means (not shown) so that selected sound effects may be heard upon the occurrence of specific events. For example, each time a run is scored, the music generating means may play the sound of people cheering. This may also be done when any type of hit is accomplished by one of the players. The sound generating means may be programmed to play other sound bits and songs throughout the game. The sound generating means includes a suitable sound system which is designed to be integrated into a game apparatus, such as apparatus 10 of the present invention. There are a number of sound systems commercially available for use in a simulated game such as the present invention.

To increase the realism of the game apparatus 10, indicia displays of several seating sections, generally indicated at 90, are disposed on either side of the scoreboard device 50. Similar to the scoreboard device 50, the seating sections 90 extend generally upward from the second end wall 28. This permits the scoreboard device 50 and seating sections 90 to extend completely across the game apparatus 10 at the second end wall 28.

As best shown in FIG. 3, the first surface 30 actually includes the playing surface of the game apparatus 10. The playing surface 30 faces upwardly during play of the game in order that a ball (not shown) can be rolled across the inclined playing surface 30. In the exemplary embodiment, the playing surface 30 has a generally planar section and is generally rectangular in shape due to the construction of the housing 20. On the playing surface 30 is outlined an infield 100, the four corners of which are a home plate 102, a first base 104, a second base 106, and a third base 108, similar to the usual infield for the sport of baseball. The playing surface 30 also includes a first base line 110 which extends linearly from the home plate 102 to the first base 104 and a third base line 112 which extends from the home plate 102 to the third base 108. Lines 114 extend between the first base 104 and the second base 106 and between the third base 108 and the second base 106. These lines 114 complete the baseball diamond and it is expected that lines 110, 112, 114 along with the home plate 102, first base 104, second base 106, and the third base 108 have a white color.

To increase the realism of the game apparatus 10, the playing surface 30 may be printed with colors representative of an actual baseball field. The playing surface 30 also includes a pitcher's mound, generally indicated at 120, from which a ball is pitched toward home plate 102 as will be described in greater detail hereinafter. One of the portions of the playing surface 30 is referred to as an outfield and is generally indicated at 130. The outfield 130 extends beyond the infield 100 up to the second end wall 28. Thus, the outfield 130 generally abuts the scoreboard 50 and the seating sections 90.

The playing surface 30 also includes a first batter's box 140 and a second batter's box 142 spaced therefrom with home plate 102 being positioned therebetween. The first batter's box 140 is referred to as a right handed batter's box and the second batter's box 142 is referred to as a left handed batter's box. Each of the boxes 140, 142 is in the form of a rectangular box and is preferably outlined with white lines. The batting area is further defined by first and second batting cage fences 143, 145, respectively. The first fence 143 is adjacent to the first batter's box 140 and extends from a location near the line 114 to the first end wall 22. The second fence 145 is spaced from and is adjacent to the second batter's box 142 and extends from a location near the line 114 to the first end wall 22. Each of the first and second fences 143, 145 has a sufficient height so that the ball may not jump over either of the fences 143, 145 but rather the movement thereof is constrained by the fences 143, 145. In one exemplary embodiment, the fences 143, 145 comprise wire fences in the shape of a "U" with leg portions serving to mount the fences 143, 145 to the playing field 29.

In one aspect of the present invention, the infield 100, including the area surrounding the home plate 102 defined by the batter boxes 140, 142, is elevated compared to the rest of the playing surface 30. For example and according to one exemplary embodiment, the infield 100 is elevated a predetermined height above the surrounding sections of the playing surface 30 to prevent a hit ball from rolling from the outfield 130 into the infield 100. For example and according to one embodiment, the infield 100 is elevated a distance greater than a radius of the ball and in one embodiment, the infield is elevated about ½ inch to about ¾ inch relative to the surrounding sections of the playing surface 30. The playing surface 30 thus has a first side section 160 and a second side section 162 with home plate 102 and the batter boxes 140, 142 being disposed therebetween. The first and second side sections 160, 162 are recessed relative to the infield 100 such that a first gap 164 is formed between the first base 104 and the first side wall 22 and a second gap 166 is formed between the third base 108 and the second side wall 24. The second gap 166 thus represents an entrance between the outfield 130 and the first side section 160 and the first gap 164 represents an entrance between the outfield 130 and the second side section 162. Because these sections surrounding the infield 100 are recessed relative to the infield 100, the ball may roll from the outfield 130 to either of the first and second side sections 160, 162 after it has been hit into the outfield 130 by the offensive player. The first side section 160 is also defined by a number of wire gates which extend upwardly and are attached to the playing surface 30 so as to restrict the travel of the baseball as it travels across the playing surface 30.

More specifically, a first wire fence 170 is constructed adjacent to the first side wall 22 so that a first foul ball slot 172 is formed between the first wire fence 170 and the first side wall 22. One end 173 of the slot 172 is open and forms an entrance into the first side section 160 while the other end 175 of the slot 172 is closed with a foul ball opening 174 being formed in the playing field 29. A second wire fence 176 is disposed within the first side section 160 and is generally "V" shaped. One end of the second fence 176 is proximate to the first fence 143 and the other end of the second fence 176 either attaches to or abuts the first fence 170. Due to the V shape of the second fence 176, a center section 177 is located proximate to the first end wall 26 and includes an apex of the second fence 176. An out opening 179 is formed in the playing field 29 and is positioned at the center section 177 (apex) so that a ball which contacts any portion of the second fence 176 will roll to the center section 177 and into the out opening 179. The out opening 179 communicates with the ball retrieval track system 300 (FIGS. 17–18) so that the ball is delivered back to the pitching mechanism 400. The ball retrieval track system 300 serves to direct the baseball back to the pitching mechanism 400 (FIGS. 9–16) so that the ball may be pitched again to the batter.

It will be appreciated that the second side section 162 preferably is in the form of a mirror image of the first side section 160 and therefore like elements have been numbered alike.

One will understand that each of the foul ball openings 174 and the out openings 179 is linked to a sensor or the like, described hereinafter, to provide a signal to the central processing unit (not shown) associated with the scoreboard device 50 indicating that a ball has fallen through one of the foul ball openings 174 and is to be counted as a strike and that a ball falling through one of the out openings 179 is to be counted as an out.

According to the present invention, an area behind home plate 102 includes a catching mechanism 150 which is used to catch the ball and record a strike in one exemplary embodiment. The catching mechanism 150 generally is formed of an opening 152 formed in the playing field 29. The fences 143, 145 serve to contain the ball within the area surrounding home plate 102 once the ball passes over home plate 102. When the offensive player does not swing at the ball using the batting mechanism 200 and the ball passes over either home plate 102 and optionally over a portion of one of the batter boxes 140, 142, a strike is recorded and the ball is captured within the opening 152. The opening 152 is generally in the form of a rectangle having sides parallel to the first end wall 26 and ends generally perpendicular to the first end wall 26. The opening 152 is in communication with the ball retrieval track system 300 so that the ball is delivered back to the pitching mechanism 400. The opening 152 is sized generally to reflect the strike zone so that the opening 152 extends from a portion of one batter's box 140 to a portion of the other batter's box 142. The same result occurs if the batter swings and misses the ball. In other words, a strike is recorded and the ball is captured within the opening 152. If the batter deflects the ball outside of the home plate area 102, an out will be recorded if the ball is directed into one of the out openings 179 and a strike is recorded if the deflected ball fails to clear the home plate area 102 and rolls into opening 152. It will also be appreciated that a mass sensor may be disposed beneath and behind home plate 102 to record a strike as the ball passes over home plate 102 regardless of where the ball ends up.

Figure 4:
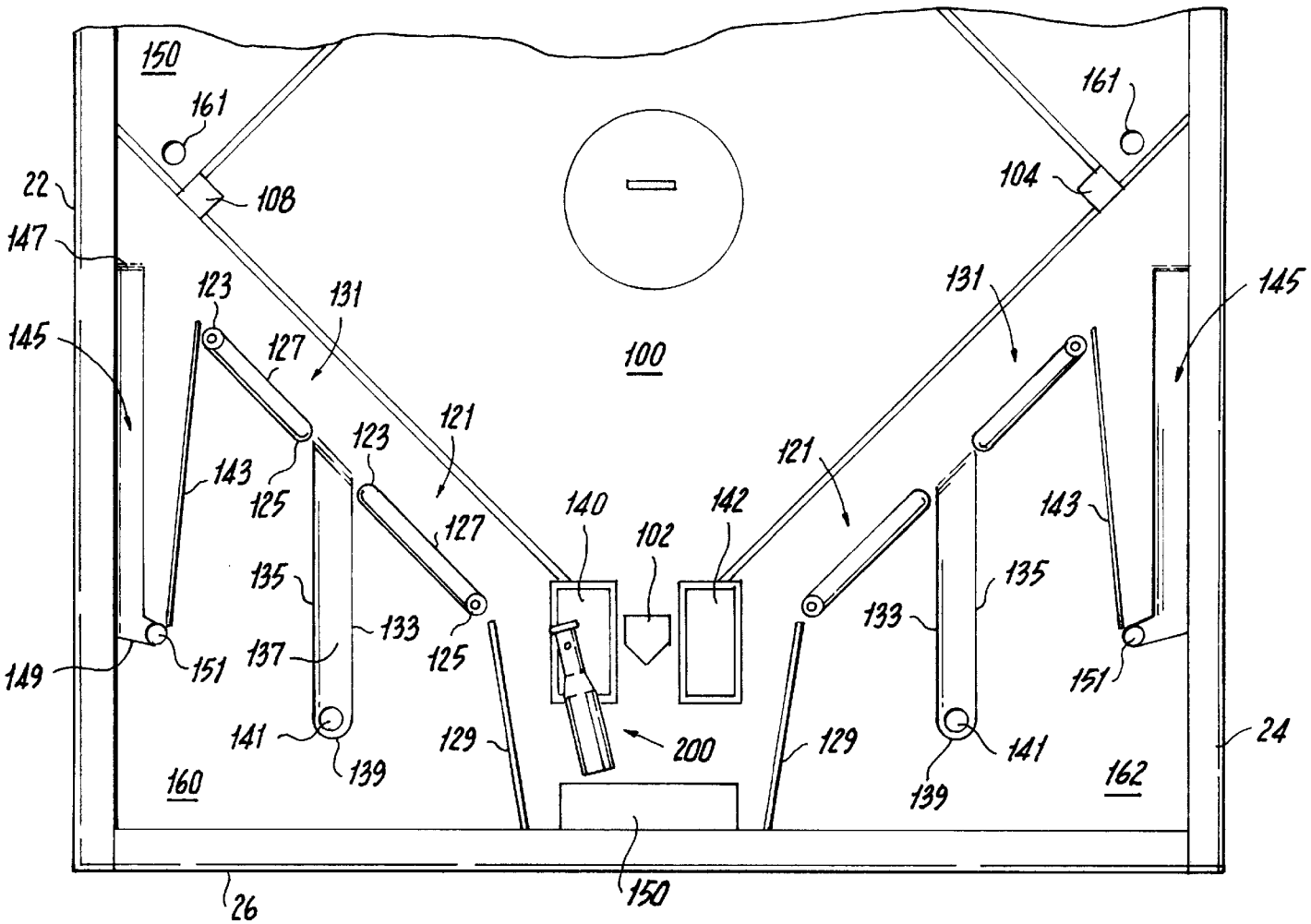
FIG. 4 is a partial top plan view of another exemplary playing surface.

Referring now to FIG. 4 in which another embodiment of the game apparatus 10 is illustrated and more specifically, in this embodiment, the first and second side sections 160, 162 of the playing surface 30 are varied. In this embodiment, two variable out/single openings 161 are formed in the playing field 29. One of the openings 161 is formed in the outfield 130 just past first base 104 and the other of the openings 161 is formed in the outfield 130 just past third base 108. In this embodiment, the elevated infield diamond 100 extends completely to the first and second side walls 22, 24 so that a ball hit past the infield 100 is prevented from rolling back into the infield 100 toward the first end wall 26. Accordingly, the openings 161 are formed proximate to the location where the elevated infield 100 intersects the first and second side walls 22, 24 such that once the ball clears the infield 100 and drops into the outfield 130, the ball will be directed into one of the openings 161 under certain conditions. For example, if the ball is not caught by the fielding mechanism 500 (FIGS. 17–18) and does not pass into the scoring mechanism 600 (FIGS. 1 and 3), the ball will begin to roll along the playing surface 30 toward the infield 100 due to the inclined nature of the playing surface 30. The ball will then either contact the elevated infield 100 on either side of second base 106 (FIG. 3) and roll into one of the respective corners defined between the infield 100 and the first or second side walls 22, 24. Because of the positioning of the openings 161, the ball will roll into one of these openings 161 and pass into the ball retrieval track system 300.

According to the present invention, the openings 161 are in communication with a sensor device (not shown) which is connected to the scoring device 50 (FIG. 2). When the ball falls within one of these openings 161, the device 50 is signaled by the sensor of such event and either an out or base hit (single) is recorded depending upon current settings of the device 50. In other words, the value of the opening 161 changes throughout the game. The device 50 uses known techniques such as using a random number generator and memory to assign the value to the openings 161. This introduces greater variety and chance into game play. It will be appreciated that the value of one opening 161 may be the same or different from the value of the other opening 161 and the value of each opening 161 will not simply alternate between an out value and a base hit value because of the introduction of the randomness of the number generator and memory. It will also be appreciated that the device 50 may be programmed so that the random number generator adds realism to the game by decreasing the odds that a base hit will be awarded. In other words, the numbers associated with an out can be programmed to outweigh the numbers associated with a base hit such that statistically it is more likely that the opening 161 will have an out value.

The first section 160 in this embodiment includes a first bumper 121 and a second bumper 131. Each of the first bumper 121 and second bumper 131 includes first and second post members 123, 125 spaced apart from one another with a resilient member 127 extending therearound so that when an object, such as the ball, impacts the resilient member 127, the ball is directed in an opposite direction thereaway toward the infield 100. The first bumper 121 is disposed closer to home plate 102 and a first fence 129 extends from a location near the first end wall 26 to one end of the first bumper 121. The first fence 129 serves to direct the ball into the opening 152 to thereby record a strike. It will also be appreciated that under certain circumstances, the offensive player may manipulate the batting mechanism 200 and attempt to hit the ball as it rolls down toward the opening 152.

Second and third fences 133, 135 are provided with the second fence 133 extending from the other end of the first bumper 121 toward the first end wall 26 and the third fence 135 extending from one end of the second bumper 131 toward the first end wall 26. The second and third fences 133, 135 are spaced generally parallel to one another to form a channel, generally indicated at 137 which receives a ball which rolls off of the infield 100 and into the first section 160. Near the first end wall 26, a connecting wall 139 extends between the second and third fences 133, 135. An out opening 141 is formed in the playing field 29 adjacent the connecting wall 139 so that a ball captured between the second and third fences 133, 135 rolls downward and into the out opening 141. A sensor (not shown) is provided in communication with the out opening 141 to signal the device 50 that an out should be recorded.

The other end of the second bumper 131 is connected to a fourth fence 143 which extends toward the first end wall 26. A groove 145 is formed in the playing surface 30 and has a first end 147 proximate the third base 108 and a second end 149 near the end of the fourth fence 143. A foul ball opening 151 is formed in the groove 145 at the second end 149. One edge of the groove 145, preferably abuts the first side wall 22. A sensor (not shown) is in communication with the foul ball opening 151 so that the device 50 is signaled when a ball drops within the foul ball opening 151. The device 50 then records a strike.

Because the first and second bumpers 121, 131 along with the out openings 141 and the foul ball openings 151 are recessed relative to the elevated infield 100 and the gaps 164, 166 (FIG. 3) of the first embodiment are eliminated, the ball reaches this first section 160 only if the ball does not clear the infield 100. For example, the offensive player may strike the ball such that the ball hits one of the side walls 22, 24 and fails to clear the infield 100. In this instance, due to the sloped nature of the playing surface 30, the ball will roll back toward the first end wall 26. As the ball drops from the elevated infield 100, the ball will roll either into one of openings 152, 141, 151. The bumper members 121, 131 add excitement as the ball may ricochet against the side edges of the infield 100 before being directed into one of the openings 152, 141, 151. Preferably, each of the fences 177,179, 183, 191 comprises a wire fence as previously-mentioned.

Figure 5:
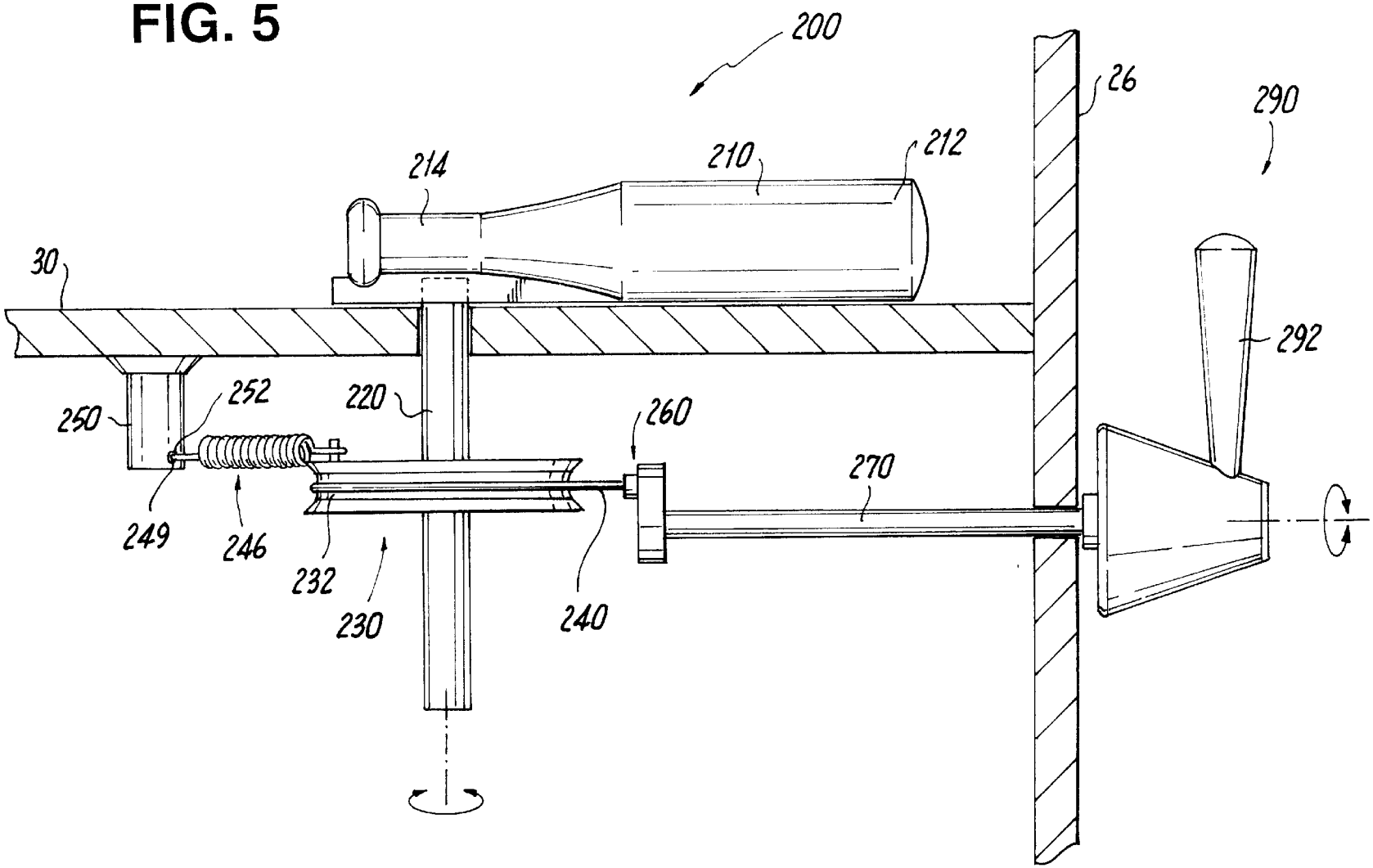
FIG. 5 is a side view of one exemplary batting mechanism for use in the apparatus of FIG. 1.
Figure 6:
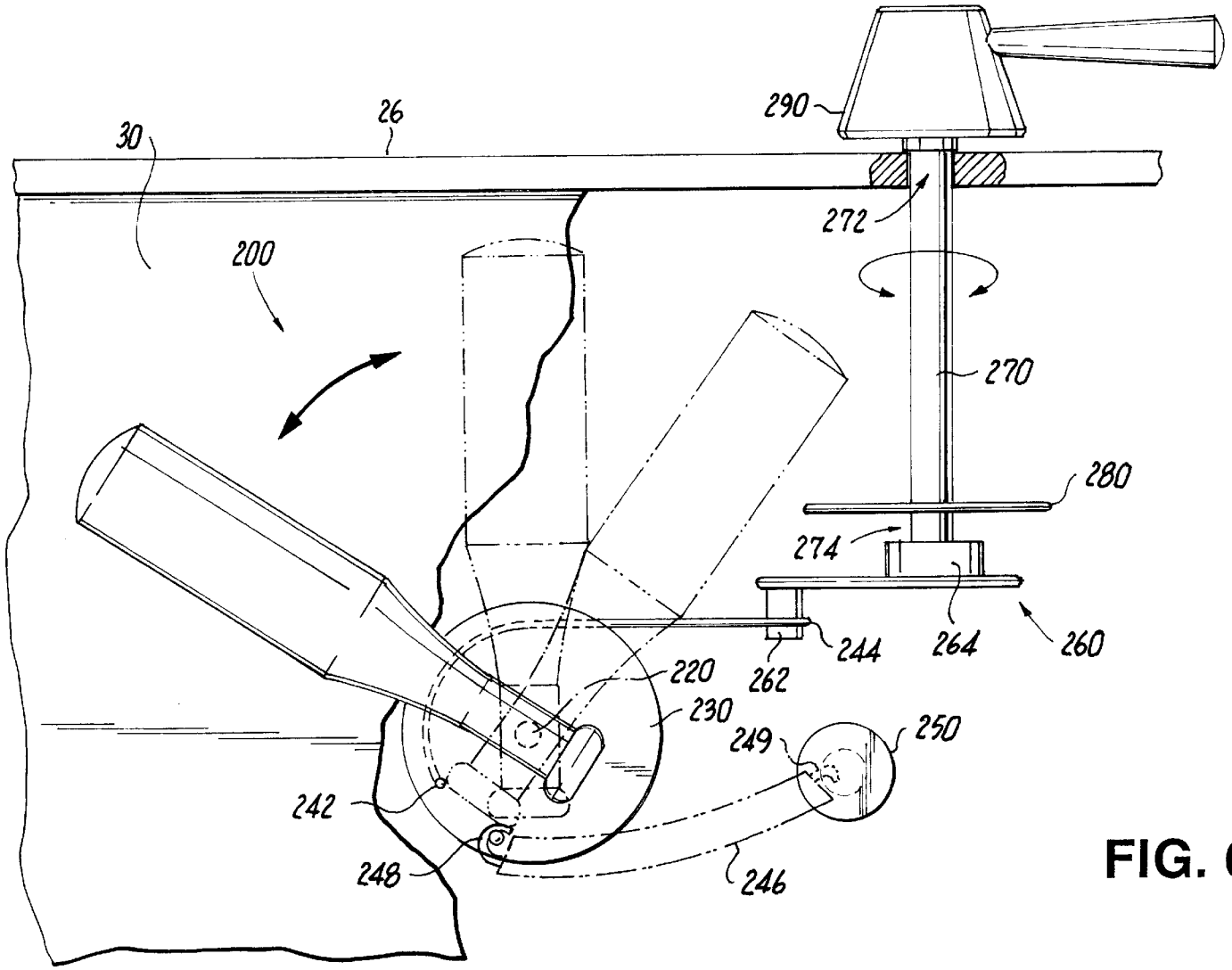
FIG. 6 is a top plan view of the batting mechanism of FIG. 5.

The batting mechanism 200 is shown in greater detail in FIGS. 1–6 and particularly in FIGS. 5 and 6. FIG. 5 is a side elevation view showing the batting mechanism 200 and FIG. 6 is a top plan view thereof. The batting mechanism 200 has a horizontally disposed batting arm 210 which extends above and parallel to the top surface 30 (FIG. 4) of the playing field 29. The batting arm 210 is preferably in the shape of a real baseball bat with a distal hitting portion 212 having a diameter greater than a proximal handle portion 214 thereof. The batting arm 210 may be formed of any suitable material and preferably is designed to have a simulated wood grain appearance so as to resemble a real baseball bat. A batting arm shaft 220 extends from a bottom portion of the batting arm 210 and is coupled to the batting arm 210 so that rotation of the shaft 220 causes the batting arm 210 to likewise rotate. Preferably, the batting arm shaft 220 is coupled to the batting arm 210 near the handle portion 214 so that a 90° angle is formed between the batting arm 210 and the shaft 220, A pulley 230 is disposed around a portion of the batting arm shaft 220 and more specifically, the pulley 230 is disposed around a lower section of the batting arm shaft 220. In the exemplary embodiment, the pulley 230 comprises an annular member having a peripheral surface 232 for slidingly engaging a cable 240. A first end 242 of the cable 240 is attached to the pulley 230 and an opposing second end 244 extends thereaway. The pulley 230 is also attached to a first end 248 of a biasing element 246. The first end 242 of the cable 240 and the first end 248 of the biasing element 246 may be attached to the pulley 230 by any number of known techniques, including using a fastener or the like. An opposite second end 249 of the biasing element 246 is attached to a first fixed member 250 which in one exemplary embodiment comprises a bracket mounted to the bottom surface 32 (FIG. 1) of the playing field 29. For example, the second end 249 may have a hook feature 252 which is received within an opening formed in the first fixed member 250. This permits the biasing element 246 to be removably attached to the first fixed member 250.

The biasing element 246 is designed to apply a biasing force to the batting arm 210 so that in a rest position the batting arm 210 is in a clocked position with the distal hitting portion 212 being positioned nearest to the first end wall 26 and the handle portion 214 generally facing the pitcher's mound 120 (FIG. 3). Once the offensive player manipulates the batting mechanism 200 to swing the batting arm 210, the biasing element 246 is displaced and the tension thereof increases. Accordingly, once the player releases the batting mechanism 200, the biasing element 246 causes the batting arm 210 to return to the clocked position as will be described in greater detail hereinafter. In one embodiment, the basing element 246 is a spring.

The second end 244 of the cable 240 is attached to a rotatable cam 260. The cam 260 has a first portion 262 and a second portion 264 with the first portion 262 extending outwardly from one end of the second portion 264. The second end 244 is actually attached to the first portion 262 and therefore rotation of the cam 260 causes the cable 240 to be driven resulting in rotational displacement of the pulley 230. The second portion 264 of the cam 260 is attached to a handle shaft 270 and in one exemplary embodiment, the second portion 264 comprises an annular member with a second end 274 of the shaft 270 extending through a center portion of the annular member. The shaft 270 comprises an elongated rod-like structure and includes a first end 272 opposite the second end 274. A support wall 280 is used to support the shaft 270 near the second end 274 thereof with the shaft 270 preferably extending through an opening formed in the support wall 280. The support wall 280 itself is mounted to the bottom surface 32 (FIG. 1) of the playing field 29, preferably in a perpendicular manner. In the exemplary embodiment, the support wall 280 comprises a rectangular member formed of any number of suitable materials, such as metal or plastic. It will also be understood that the first end 272 of the shaft 270 may similarly be supported by a member (not shown), such as a bracket.

The first end 272 of the shaft 270 is coupled to a handle 290. The handle 290 has a base portion 292 which attaches to the first end 272 and a grip portion 294 extends therefrom. The grip portion 294 is preferably in the form of an elongated member which may be either gripped or spun by a user's hand. It is intended that the handle 290 is to be rotated causing rotation of other respective members, i.e., the handle 270, cam 260, pulley 230, and shaft 220, which results in a swinging motion in the batting arm 210. The batting mechanism 200 is generally removed from the view of the players with the exception that a portion of the handle shaft 270 and the handle 290 are disposed outside of the housing 20 (FIG. 1) at the first end wall 26 (FIG. 1). The handle 290 extends slightly away from first end wall 26 so that the offensive player may grip and easily rotate the handle 290 to cause swinging of the batting arm 210. The grip portion 292 lies generally parallel to the first end wall 26. Similarly, a portion of the shaft 220 and the batting arm 210 lie above the top surface 30.

The operation of the batting mechanism 200 will now be described with reference to FIGS. 1–6. As the ball travels down the infield 100 toward home plate 102, the offensive player (the batter) will determine whether the batting arm 210 is to be swung in an attempt to hit the ball. If the player decides to swing the bat, the player will rotate the handle 290 at a predetermined speed to cause the batting arm 210 to accelerate in a swinging motion toward the traveling ball. By rotating the handle 290, the cam 260 is also rotated in the same respective direction. This rotation of the cam 260 causes the rotational displacement of the second portion 264 of the cam 260 resulting in the cable 240 being pulled. Because the first end 242 of the cable 240 is attached to the pulley 230, the pulling of the cable 240 causes the pulley 230 to rotate from the initial rest position. The pulling action of the cable 240 causes the biasing element 246 to be elongated and the energy stored in the biasing element 246 increases and produces a return force.

It will also be appreciated that the batting arm 210 is swung as the pulley 230 and the shaft 220 attached thereto are rotated. Once the swing has been completed and the player releases the handle 290 or moves the handle 290 in an opposite direction, the return force of the biasing element 246 directs the batting arm 210 to its initial clocked position. The tension built-up in the biasing element 246 during the swing of the batting arm 210 is thus released. The batting mechanism 200 of the present invention is thus designed so that the offensive player may control the degree and speed of the swing by simply manipulating the handle 290. If the player desires for the batting arm 210 to be swung with increased speed, the player simply rotates the handle 290 with increased speed. The batting mechanism 200 further simulates the game of baseball because the timing of the swing and decision of whether to swing or not are determined by the player within a very short period of time. The skill of the individual player in seeing the baseball and its pitch direction will impact how effectively each player can make contact with the baseball and achieve a hit.

Figure 7:
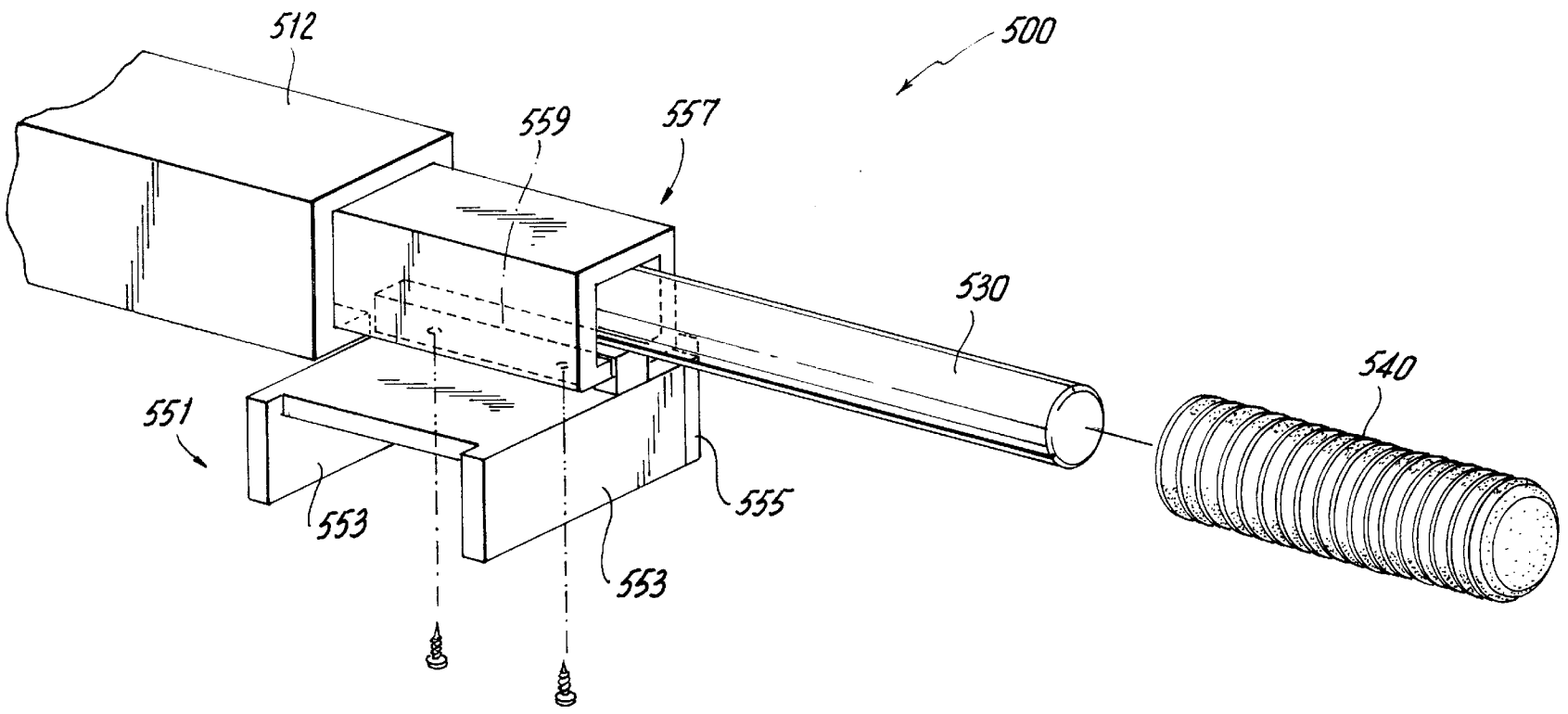
FIG. 7 is a front perspective view of one exemplary fielding mechanism for use in the apparatus of FIG. 1.
Figure 8:
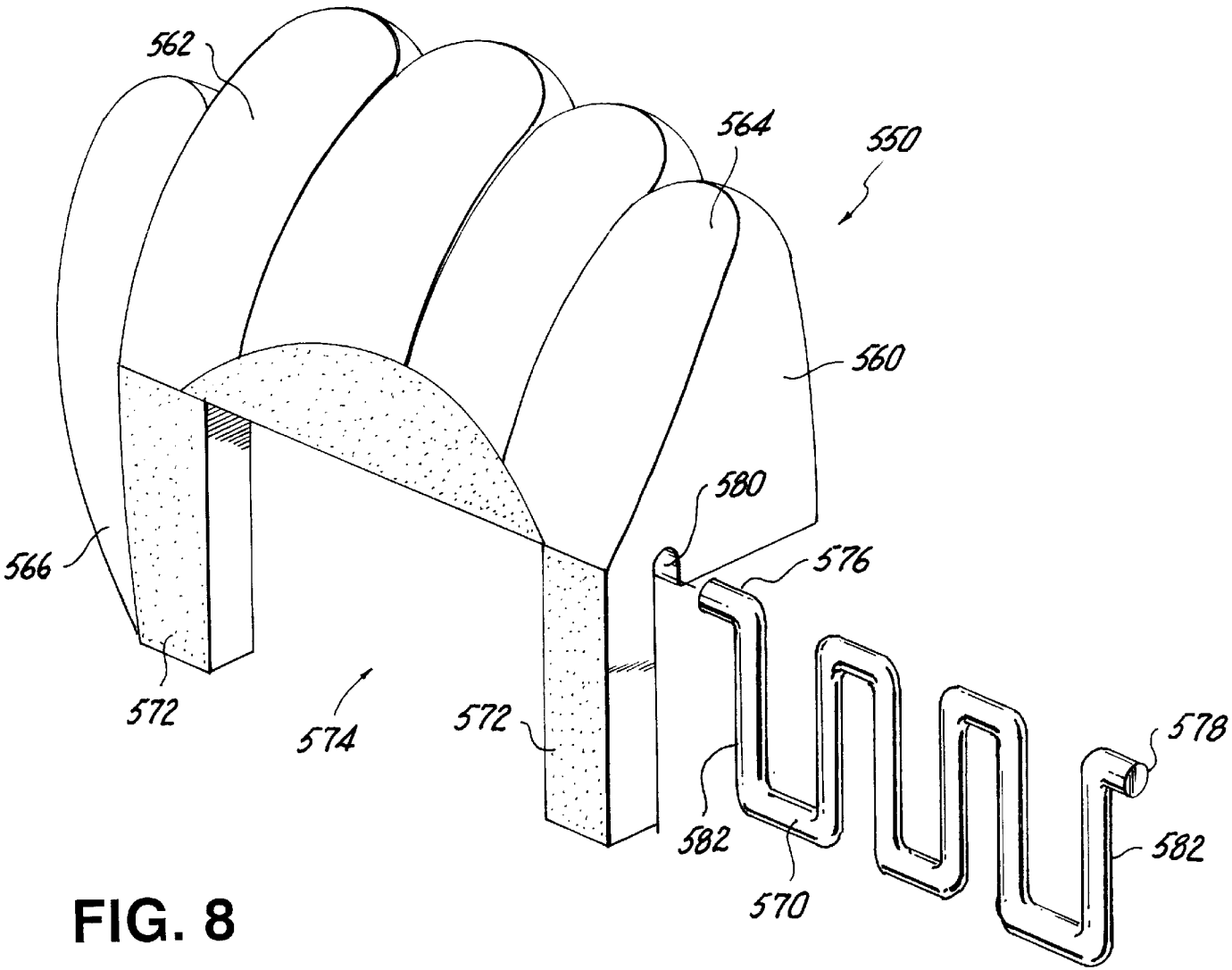
FIG. 8 is a front perspective view of a glove assembly for use in the fielding mechanism of FIG. 7.
Figure 9:
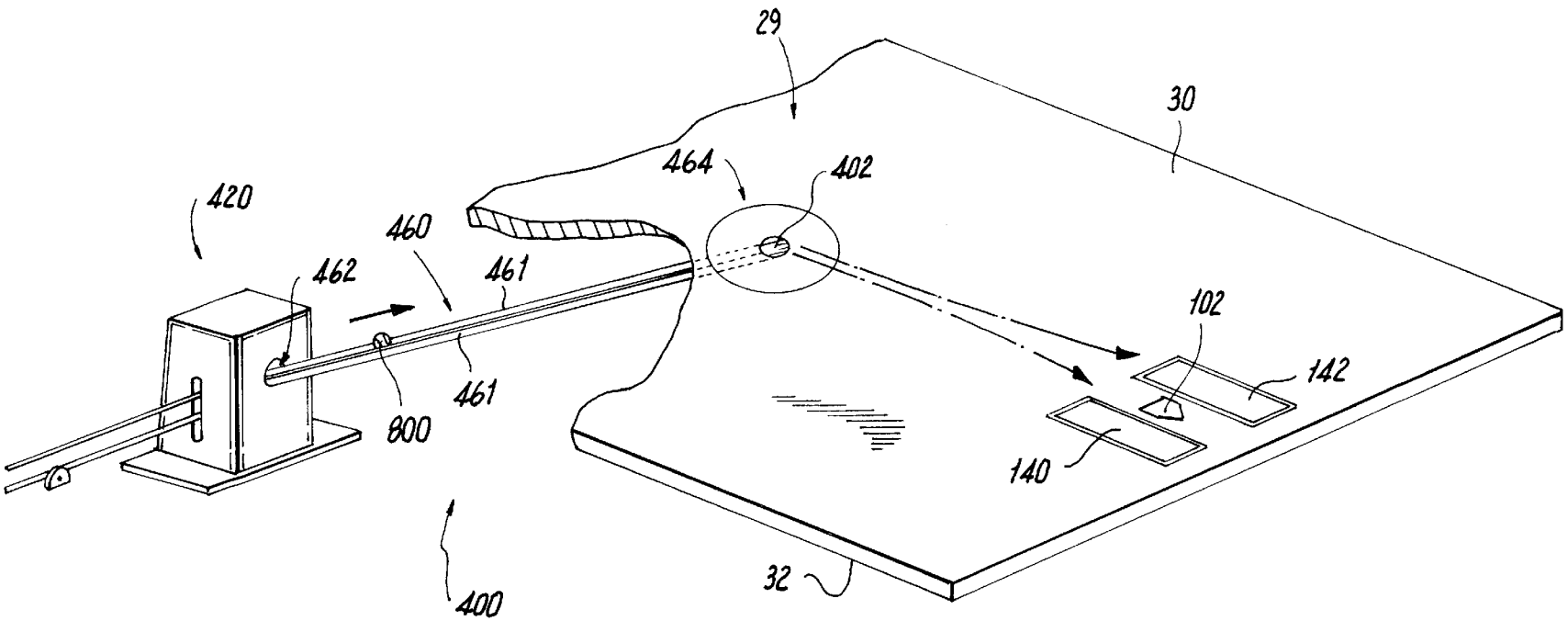
FIG. 9 is a side perspective view of a portion of one exemplary pitching mechanism for use in the apparatus of FIG. 1.

Referring now to FIGS. 1–8 with particular attention to FIGS. 7–8 in which the fielding mechanism 500 is shown in greater detail. The fielding mechanism 500 is generally formed of a first movable fielding member 510 and a second movable fielding member 520 which are coupled to the game apparatus 10. FIG. 7 is a partial exploded perspective view illustrating one of the first and second movable fielding members 510, 520. The first movable fielding member 510 is positioned approximately where the infield 100 transitions into the outfield 130 and the second movable fielding member 520 is positioned between the first movable fielding member 510 and the second end wall 28. Each of the first and second movable members 510, 520 includes a support member 512 which extends between the first and second side walls 22, 24. The support member 512 is attached to both the first and second side walls 22, 24 by any number of techniques. For example, a bracket with fasteners may be used to secure one or more ends of the support member 512. In the exemplary embodiment, the support member 512 comprises a tubular structure having a rectangular cross-section.

Each of the first and second movable fielding members 510, 520 also includes a sliding rod 530 which has a handle 540 attached to one end thereof. As will be described in greater detail hereinafter, the rod 530 is disposed within an interior of a slidable block, generally indicated at 557, which is itself designed to slidingly travel within an interior of the support member 512. The rod 530 has a length so that in a first retracted position, a distal end of the rod 530 is in contact with or close to contact with the second side wall 24. In this first retracted position, the handle 540 is disposed in close proximity to an outer surface of the first side wall 22. In other words, the handle 540 is disposed exterior to the housing 20. The handle 540 may comprise any number of handle devices commercially available and preferably, the handle 540 is formed of a rubber-like material and includes means for gripping the handle 540. For example, the handle 540 may include a number of flanges or other types of protrusions which permit the defensive player to grip and move the rod 530 in lateral directions. The rod 530 and handle 540 are preferably annular in cross-section. The rod 530 is freely slidable within the slidable block 557 permitting the user to pull the rod 530 by the handle 540 in a direction away from the first side wall 22. This permits the rod 530 to move from the first retracted position to a second extended position and positions therebetween.

Each of the first and second movable members 510, 520 of the fielding mechanism 500 includes several glove assemblies, generally indicated at 550 for capturing a ball driven by the offensive batter (best shown in FIG. 8). In the exemplary embodiment, there are two glove assemblies 550 for each of the first and second movable members 510, 520. Each glove assembly 550 is attached to the rod 530 using the slidable block 557 so that movement of the rod 530 within the slidable block 557 causes movement of the glove assembly 550 in the same direction. The glove assemblies 550 may be attached to the slidable block 557 by suitable methods including using several fasteners, e.g., screws.

Each exemplary glove assembly 550 is formed of the slidable block 557, a base member 551, a glove-like body member 560 and a gate 570 pivotally attached thereto. As best shown in FIG. 7, the base member 551 is a generally square structure having a pair of side walls 553 and a single end wall 555 extending therebetween. The base member 551 is thus open-ended at the end opposite the end wall 555 so that the miniature ball may travel through this open end and be captured between the end wall 555 and side walls 553. The base member 551 is connected to the rod 530 by extending fasteners or the like through the slidable block 557 and into the rod 530 so as to couple the three components to one another. The slidable block 557 has a longitudinally extending protrusion 559 which is sized to be received within a complementary longitudinal slot (not shown) of the support member 512 to permit the slidable block 557 to travel within the interior of the support member 512. Thus, this longitudinal slot permits the sliding movement of the glove assembly 550 and the rod 530 within the support member 512. Preferably, the base member 551 is formed of a transparent material, such as a transparent plastic.

As best shown in FIG. 8, the body member 560 has a front surface 562 defined by an upper section 564 and a lower section 566. The upper section 564 is shaped in the form of a baseball glove and thus includes a thumb portion along with finger portions. In order to increase the realism of such glove assembly 550, the upper section 564 may contain markings representing stitching and the like. The lower section 566 has a pair of legs 572 which extend downward away from the upper section 564. Formed between the legs 564 is a ball opening 574. The ball opening 574 is of sufficient size to receive the miniature baseball used during play of the game apparatus 10. The body member 560 attaches to the base member 551 so that the ball opening 574 is aligned within the open end of the base member 551.

The gate 570 comprises what is often referred to as a swing door and is typically formed of wire. The gate 570 has a first end 576 and a second end 578 and is bent in a generally serpentine manner between the first and second ends 576, 578. Each of the first and second ends 576, 578 is angled outward to form a pivotally attachment point between the gate 570 and the body member 560. More specifically, the body member 560 has a pair of slots 580 formed therein at both ends thereof for receiving the gate 570. The gate 570 attaches to the body member 560 by inserting the first and second ends 576, 578 within the slots 580. When the gate 570 is pivotally attached to the body member 560, the gate 570 extends across the ball opening 574 and end vertical portions 582 of the gate 570 are disposed behind the legs 572 of the body member 560.

This type of gate 570 is known as a unidirectional gate because it may only open in one direction. When the ball is traveling across the top surface 30 and travels within the ball opening 574 and makes contact with the gate 570, the gate 570 pivots about its first and second ends 576, 578 such that the ball travels into the base member 551. After the ball clears the gate 570, the gate 570 pivots in the opposite direction to the original closed position. Even if the ball strikes the gate 570 in an opposing direction away from the end wall 555, the gate 570 cannot pivot open because the end vertical portions 582 of the gate 570 are disposed behind the legs 572. The legs 572 thus restrict and prevent the gate 570 from freely pivoting open in this opposite direction.

The operation of the fielding mechanism 500 will now be described. The fielding mechanism 500 is thus designed to capture and retain a ball which is hit by the offensive player and then "caught" by the defensive player. After the defensive player has pitched the ball by the method described hereinafter, the player will then preferably place his/her left hand on the first movable member 510 and his/her right hand on the second movable member 520. If the ball is hit by the offensive player, the defensive player may record an out by catching the hit ball using the fielding mechanism 500. Because the rods 530 slidably travel within the slidable blocks 557 and the glove assemblies 550 are attached to the rods 530, the gloves assemblies 550 may be moved laterally across the top surface 30. The first movable member 510 is positioned just beyond second base 106 and thus comprises the first line of defensive for catching the ball. The second movable member 520 is positioned beyond the first movable member 510 and thus comprises a second line of defense. By having one hand on each of the members 510, 520, the player may use both hands to extend and retract the members 510, 520 in an effort to align one of the glove assemblies 550 with the struck ball. Such action by the defensive player will be familiar to fans of table games as being similar to the player action in a game known by the name "foosball" or "table soccer".

An individual player may strategize by initially positioning the first and second movable members 510, 520 in offset positions so as to try to optimize the chances of the ball striking one of the glove assemblies 550. Because the ball may be hit too fast for the defensive player to react and use the first movable member 510, the player may elect to concentrate on catching the ball with the second movable member 520. Such decisions are left to the individual player and will also vary according to the how fast the ball is hit and the direction it is hit. If the defensive player is able to align one of the glove assemblies 550 with the hit ball and the ball swings the gate 570 open and becomes captured within the base member 551, the defensive player records the out by depositing the caught ball within an out opening 591 formed in the playing field 29.

In one exemplary embodiment, there are four out openings 591 formed in the playing field 29. Two out openings 591 are aligned with the glove assemblies 550 of the first movable member 510 and the other two out openings 591 are aligned with the glove assemblies 550 of the second movable member 520. Preferably, the out openings 591 are formed adjacent one of the first and second side walls 22, 24. It is intended that depending upon which glove assembly 550 catches the ball, the defensive player will then adjust the respective first or second movable member 510, 520 to deposit the captured ball within the nearest out opening 591. Once the glove assembly 550 is positioned over the out opening 591, the ball will drop by gravity into the out opening 591. One will appreciate that additional out openings 591 may be formed in the playing field 29 so long as each out opening 591 is axially aligned with the glove assemblies 550 of one of the first and second movable members 510, 520.

The fielding mechanism 500 provides additional player involvement by the defensive player and further provides an effective and challenging way of recording an out after the offensive player has successfully hit the ball.

Referring now to FIGS. 1–3, the game apparatus 10 further includes a scoring and hit mechanism 600 which provides one means for recording a hit and generating runs while playing the game apparatus 10. The scoring and hit mechanism 600 comprises a number of spaced indicators 610 positioned in the outfield 130 near the second end wall 24. The indicators 610 extend across the top surface 30 between the first and second side walls 22, 24. Each indicator 610 is generally in the form of a gate which similar to the gate 570 of the glove assembly 550 is opened in only one direction so as to prevent the ball from reentering the playing field. Each indicator 610 has an associated value and has indicia printed thereon for representing the value of the individual indicator 610. For example, all possible hit combinations are represented and the player will be rewarded the displayed value of the indicator 610 when the ball contacts the respective indicator 610 and swings it open. Next adjacent indicators 610 are preferably separated from one another by posts 611 which are used to provide a pivotal attachment point for the indicators 610 and also define a slot or opening for the ball to travel within. The posts 611 also make scoring slightly more difficult because if the offensive player strikes the ball and it hits one of the posts 611, the ball will be directed back toward the infield 100 without the ball having struck one of the indicators 610 and registering a hit or other event.

Preferably, the value of the indicators 610 are weighted due to the likelihood of such a hit being achieved. For example, it is generally known that the hardest hits to achieve during a baseball game is a triple and home run. Therefore in the design of the scoring mechanism 600, the number of indicators 600 which have a value of either a triple or home run should be low in comparison with the other types of hits. For example, there should be more single indicators 610 then any other types of indicators, followed by double indicators 610. There are other alternative methods of providing an accurate scoring mechanism 600 such as varying the width or opening of the indicators 610. Because a triple and home run are the hardest hits to achieve, the indicators 610 representing a triple and home run would have the shortest widths compared to the other indicators 610. Because a hit is recorded by contacting and swinging open one of the indicators 610, decreasing the width of the target (indicator 610 ) will likewise decrease the chances of the offensive player striking this particular indicator 610.

It will also be appreciated that indicators 610 do not have to be limited to representing certain types of hits. Some of the indicators 610 may represent other types of baseball events such as one base awarded due to a fielding error, a passed ball, a hit batsman, etc. The individual indicators 610 are electronically connected to the scoreboard device 50 and more particularly to the CPU thereof so that when a ball strikes and pivots open one of the indicators 610, a signal from a sensor or the like is delivered to the CPU which then determines what type of hit was achieved based upon the signal received from the particular indicator 610. The CPU has various memory sections which keep track of how many runners are on particular bases along with the number of outs. The CPU is programmed so that typical results will occur in a given situation. For example, if a runner is on second base 106 and the batter hits a double, the runner will score from second base 106. It will be appreciated that the CPU may be programmed to generate random results in some situations. For example, if a runner is on second base 106 and the batter hits a single, the runner may or may not score. The CPU may be programmed so that a predetermined percent of the time, the runner will score from second base 106 when the batter hits a single.

Behind the indicators 610 a trough, generally indicated at 700, is formed in the top surface 30 of the playing field 29. The trough 700 extends across a width of the game apparatus 10 between the first and second side walls 22, 24. The trough 700 is designed to catch any ball which passes through one of the indicators 610 after the sensor has been triggered. Accordingly, the trough 700 is preferably sloped toward a predetermined location along the trough 700 so that the ball will roll toward this lowest point of the trough 700. The trough 700 communicates with a ball opening (not shown) formed in the playing field 29 so that the ball falls through the ball opening and is returned back to the pitching mechanism 400 through the ball retrieval track system 300. The trough 700 is thus formed between the indicators 610 and the scoreboard device 50 and the seating sections 90.

Now referring to FIGS. 1, 3, and 9–16 in which the pitching mechanism 400 is shown in greater detail. The pitcher's mound 120 includes a ball exit opening 402 formed in the playing field 29 in the general location of the pitcher's mound 120. According to the present invention, the ball is delivered to the exit opening 402 where it exits onto the top surface 30. The ball then rolls toward the area of home plate 102 where the offensive player uses the batting mechanism 200 for striking the ball and delivering a safe hit. The pitching mechanism 400 is designed to effectively simulate the pitching aspect of a real baseball game. For example, the pitching mechanism 400 permits the defensive player to strategize and chose between various pitches as the defensive player tries to outsmart the offensive player by delivering a pitch or combination of pitches which causes the offensive player to erroneously swing and miss the ball.

The pitching mechanism 400 includes a joystick mechanism, generally indicated at 410, which comprises means for the defensive player to select a pitch and a striker mechanism, generally indicated at 420, which comprises the means for effectuating delivery of the ball from the pitcher's mound 120. In the exemplary embodiment, the joystick mechanism 410 and the striker mechanism 420 are positioned along the first side wall 22 on one side of the fielding mechanism 500 so that the defensive player stands along one side of the game apparatus. The defensive player is sufficiently removed from the offensive player, who stands behind the first end wall 26 to manipulate the batting mechanism 200, so that the pitch selection may be made without the batter knowing the selection.

The joystick mechanism 410 includes a joystick 412 which extends outwardly from the first side wall 22. The joystick 412 has a handle 414, preferably ball shaped, and a shaft 416 connected thereto. The shaft 416 extends through the first end wall 26 with the handle 414 being on the exterior of the housing 20.

Figure 10:
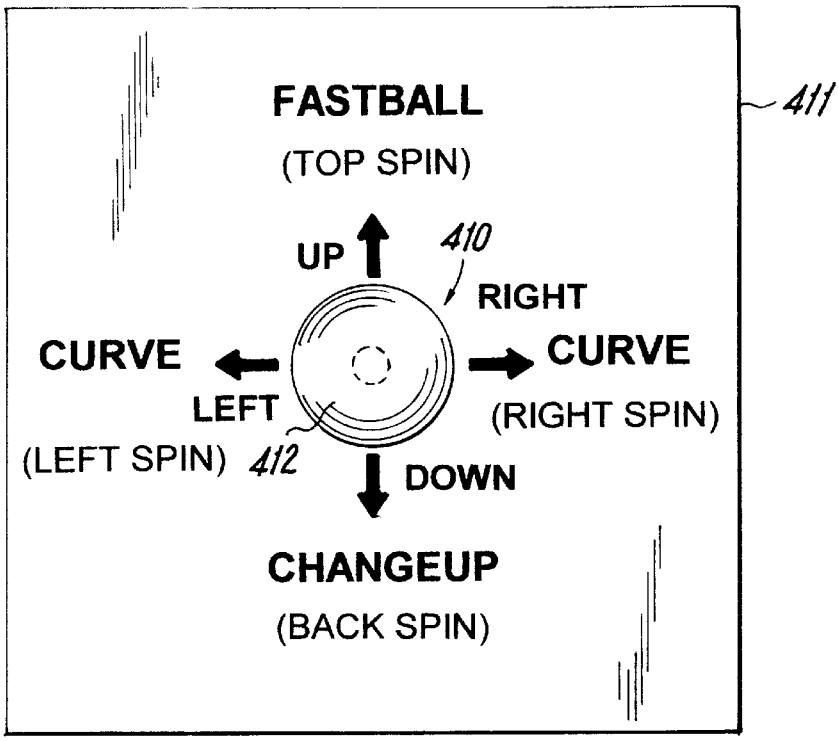
FIG. 10 is a front view of a display plate of the pitching mechanism of FIG. 9.
Figure 15A:
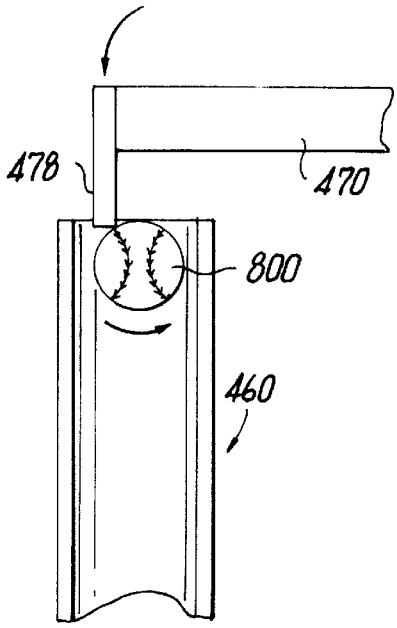
FIGS. 15A–C are top plan views of the pitching striker for driving the ball along the ball trough in which the relative striking position is varied by manipulating the position of the ball trough.

A display plate 411 is attached to exterior surface of the first side wall 22 and includes indicia representing the various different pitches that may be selected by the defensive player. In one exemplary embodiment, the display plate 411 surrounds the shaft 416 and offers the defensive player five possible types of pitches, as best shown in FIG. 10. If the joystick 412 is maintained in the center position (default position), a ball with little spin will be delivered down the center of the infield 100 to home plate 102. Because this pitch is delivered down the center, the likelihood of the pitch being within the strike zone is high; however, it is also a desirable pitch for the offensive player in that solid contact may be made with such a pitch if the batter's swing is timed properly. If the joystick 412 is moved to an upper position, a top spin ball (overspin) will be delivered to the batter. The top spin ball is delivered down the center of the infield 100 resulting in increased strike and hitting opportunities. If the joystick 412 is moved to a lower position, a change-up pitch (backspin pitch) is delivered to the batter. Like the other pitches, the change-up pitch is delivered down the center of the infield 100. If the joystick 412 is moved to a left position (FIG. 15*c*), a curve ball is delivered where the ball curves to the left toward the first batter's box 140 and if the joystick 412 is moved to a right position, a curve ball is delivered where the ball curves to the right toward the second batter's box 142 (FIG. 15*a*). Preferably indicia, such as text or graphical representations, are printed on the display plate 411.

Figure 11:
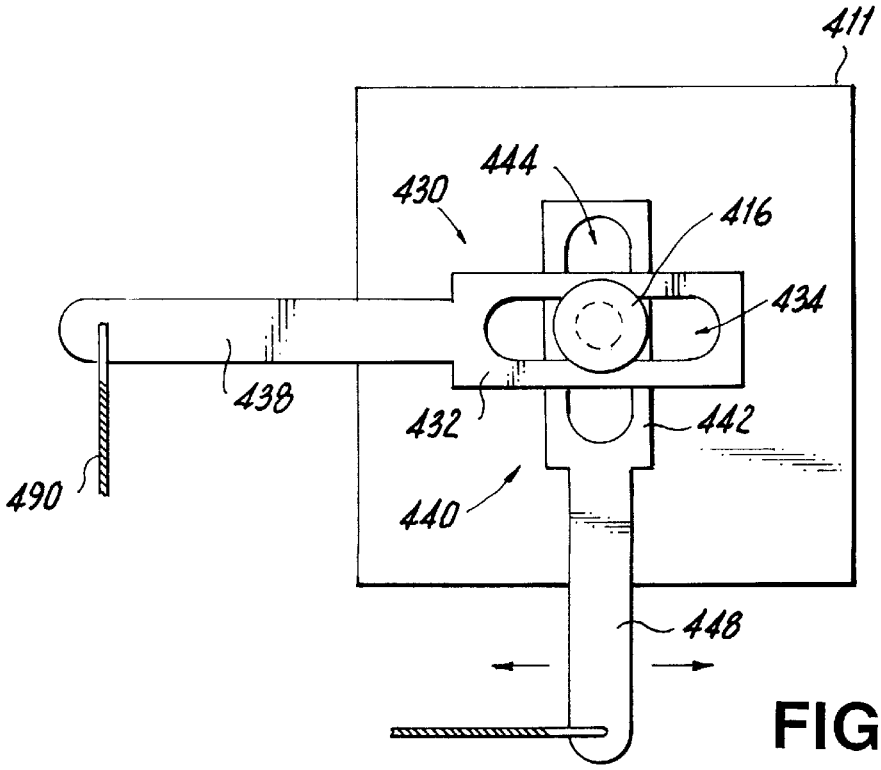
FIG. 11 is a rear view of the display plate of FIG. 10.
Figure 12:
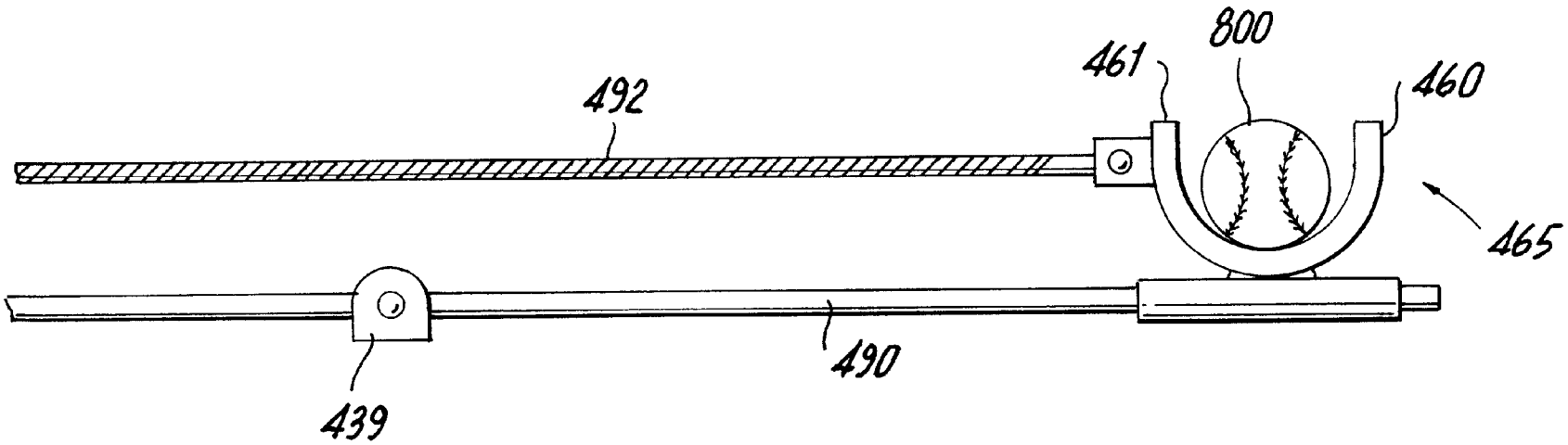
FIG. 12 is a side view of a ball trough and pitching linkage assembly for manipulating the position of a ball with respect to a pitching striker.
Figure 13:
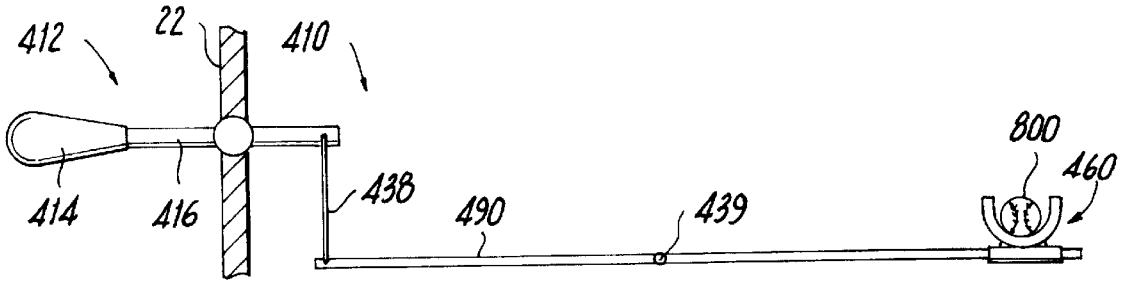
FIG. 13 is side view of a joystick coupled to the pitching linkage assembly.
Figure 14:
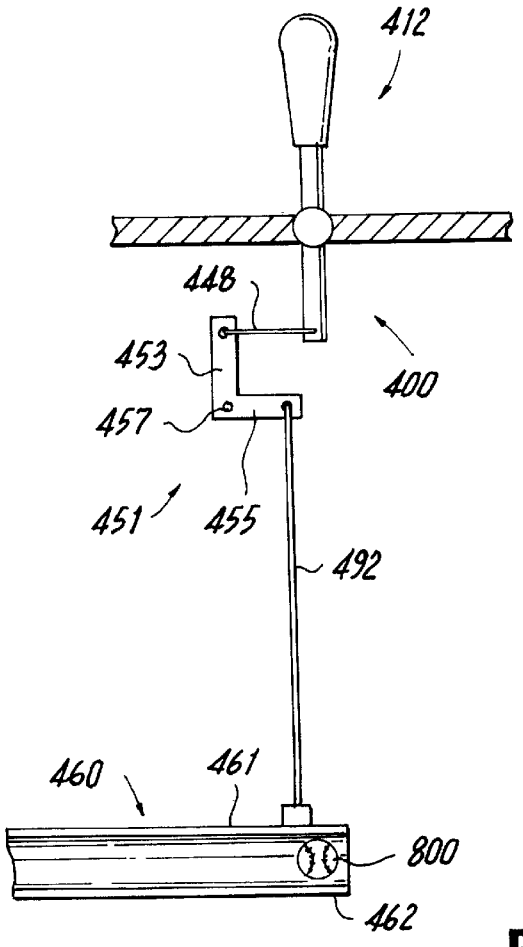
FIG. 14. Is a top plan view of the joystick coupled to the pitching linkage assembly.

FIG. 11 is a rear view of a portion of the pitching mechanism 400 showing the display plate 411 and shaft 416. As shown, the pitching mechanism 400 includes a first linkage 430 having a first linkage plate 432 and a second linkage 440 having a second linkage plate 442 which cooperate with each other to control the selection of the pitch. The first linkage plate 432 has a first slot 434 formed therein for receiving one end of the shaft 416. Similarly, the second linkage plate 442 has a second slot 444 formed therein for receiving the one end of the shaft 416. The first linkage plate 432, along with the first slot 434, is disposed generally horizontal relative to the display plate 411 and the second linkage plate 442 is disposed generally vertical relative to the display plate 411. The first and second linkage plates 432 and 442 thus overlay one another and are generally perpendicularly positioned relative to one another.

When the joystick 412 is in the center (default) position, the shaft 416 lies in the center of both the first and second slots 434, 444. It will therefore be appreciated that the movement of the joystick 412 causes the shaft 416 to engage and displace one of the first and second linkage plates 432, 442. For example, when the joystick 412 is moved to the up position, the shaft 416 is free to move within the second slot 444 (vertical slot) but engages and displaces the first linkage plate 432 in an upward direction. This causes a first linkage arm 438 to be directed in the opposite downward direction. The first linkage arm 438 extends outwardly from the first linkage plate 432. Similarly, the movement of the joystick 412 to the down position causes the shaft 416 to contact the first linkage plate 432 while the shaft is free to travel within the second slot 444. This results in the first linkage arm 438 being directed in the upward direction. The movement of the joystick 412 to the left position causes the shaft 416 to contact the second linkage plate 442 while the shaft is free to travel within the first slot 434. This engagement between the shaft 416 and the second linkage plate 442 causes a second linkage arm 448 to move in the opposite right direction. The second linkage arm 448 extends generally downward from the second linkage plate 442. When the joystick 412 is moved to the right position, the shaft 416 engages the second linkage plate 442 while freely traveling within the first slot 434. This positioning of the joystick 412 in the right position results in the second linkage arm 448 moving in the opposite left direction.

The striker mechanism 420 of the pitching mechanism 400 (FIG. 9) causes a miniature ball 800 to be driven within a ball trough 460 to the exit opening 402 at the pitcher's mound 120. The ball 800 may be made of any number of suitable materials and preferably is formed of metal, e.g., steel. The ball trough 460 has a first end 462 proximate to the striker mechanism 420 and an opposing second end 464 in communication with the exit opening 402 so that the accelerated ball 800 travels within the ball trough 460 and then exits at the opening 402 into the infield 100. The ball trough 460 is therefore shaped and sized to carry the ball 800 and preferably, the ball trough 460 comprises a generally arcuate member. Vertical edges 461 of the ball trough 460 contain the ball 800 within the ball trough 460 and should have a sufficient height to contain the ball after it has been struck and accelerated by the striker mechanism 420. An inner surface 465 of the ball trough 460 is preferably smooth to permit the ball 800 to freely travel along the inner surface 465. The ball trough 460 may be formed of a number of materials and in one exemplary embodiment, the ball trough 460 is formed of a plastic.

The striker mechanism 420 comprises a spring loaded arm which is operated by the defensive player and for the most part, the components of the striker mechanism 420 are for hidden from view underneath the playing field 29. The striker mechanism 420 is disposed within the first side wall 22 and includes a biased plunger 422 having a handle knob. The plunger 422 is preferably surrounded by a support plate 426 which is attached to the outer surface of the first side wall 22. The plunger 422 is in the form of an elongated member, such as a rod, which in a rest position is in a retracted position. The plunger 422 has a biasing element, e.g., a spring, (not shown) disposed around a portion thereof for generating a return force when the plunger 422 is pulled by the defensive player in a direction toward the body of the player. Opposite to the knob, the plunger 422 typically includes a stopper (not shown) which has a size greater than a diameter of the plunger 422. The biasing element is usually disposed around the plunger 422 in a location between the stopper and the first side wall 22 such that a pulling action on the plunger 422 causes the biasing element to be compressed between the stopper and the first side wall 22. This compression results in energy being stored in the biasing element. When the plunger 422 is released from this extended position, the biasing element releases the energy and the plunger 422 is caused to return to the initial retracted position.

Figure 16A:
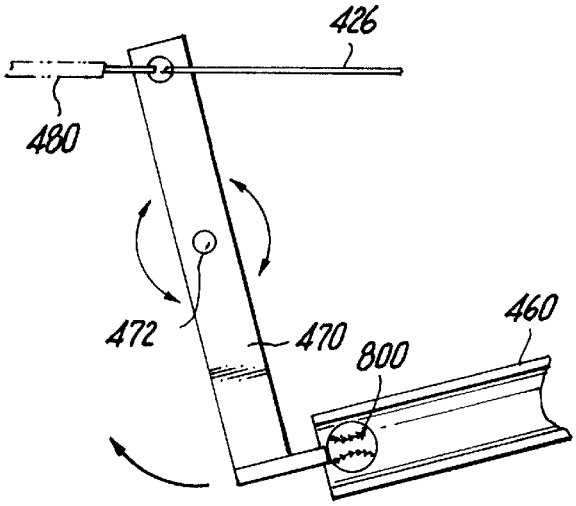
FIGS. 16A–C are top plan views of one exemplary striker mechanism in which the sequential motion of the striker is illustrated.
Figure 16B:
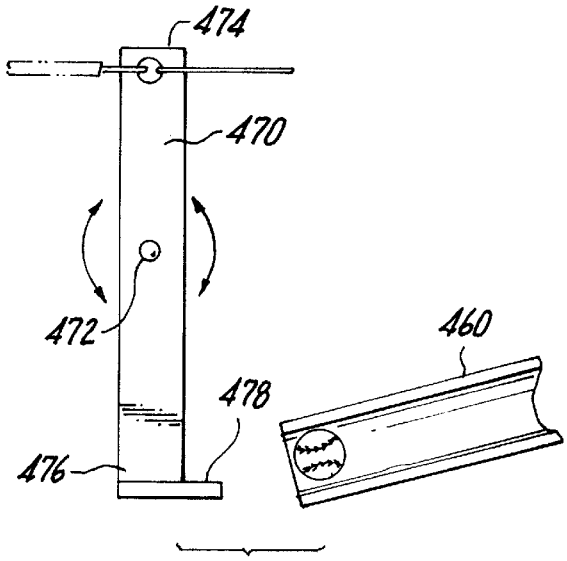
Figure 16C:
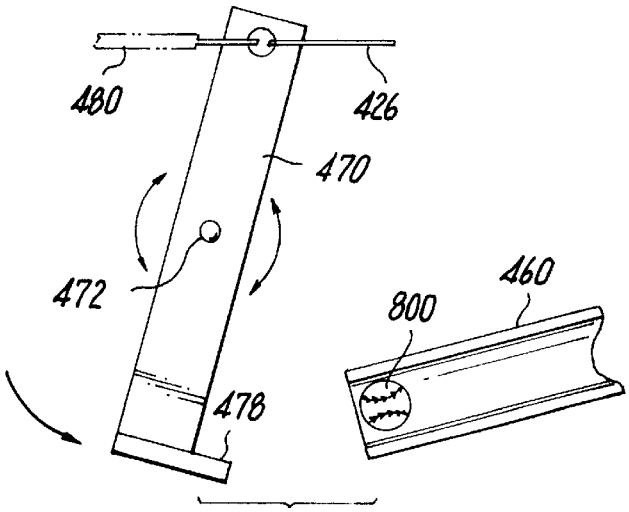

According to one exemplary embodiment and as best shown in FIGS. 16A–C, an end of the plunger 422 opposite the knob is attached to a cable 426. The cable 426 extends from the plunger 422 to a pivotal striker arm 470. The exemplary striker arm 470 pivots about a pivot point 472 and includes a first end 474 and a second end 476. One end of the cable 426 attaches to the first end 474. The second end 476 includes a striker 478 which comprises a surface of the striker arm 470 which makes contact with and drives the ball 800. The striker 478 is designed to have a sufficient size to permit the striker 478 to be received between the vertical edges of the ball trough 460 so that the ball 800 is squarely struck. The striker arm 470 has a second biasing element 480 attached to the first end 474 with the biasing element 480 extending in an opposite direction relative to the cable 426. For example, the first end 474 may have an opening formed therein which receives both the cable 426 and one end of the second biasing element 480.

In the exemplary embodiment, the second biasing element 480 comprises a spring which generates a return force when the plunger 422 is pulled to the retracted position shown in FIG. 16C. More specifically, when the plunger 422 is pulled toward the body of the defensive player, the cable 426 is also pulled in the same direction. This results in the striker arm 470 pivoting about the pivot point 472. For example, the pulling of the cable 426 causes clockwise rotation of the striker arm 470. The ball trough 460 is located proximate to the striker arm 470 and is generally aligned with the striker 478 in the initial rest position. In fact, in the rest position shown in FIG. 16A, the striker 478 may be in contact with the ball 800 so that when the striker 478 accelerates back to the rest position, it contacts and drives the ball 800 through the ball trough 460. When the plunger 422 is fully retracted (FIG. 16C), the striker 478 has pivoted away from the ball trough 460 and the second biasing element 480 is extended. The extension of the second biasing element 480 results in energy being stored therein. When the plunger 422 is released, the second biasing element 480 releases its energy causing the striker arm 470 to pivot in the opposite counter clockwise direction (as shown in FIG. 16B) toward the initial rest position. This sudden release of energy causes the striker arm 470 to accelerate toward the ball trough 460 and more specifically, the striker 478 accelerates toward the ball 800. The striker 478 contacts and drives the ball 800 within the ball trough 460 toward the exit opening 402. After the second biasing element 480 releases all of its stored energy, the striker arm 470 is orientated in the initial rest position shown in FIG. 16A.

According to the present invention, the position of the ball trough 460 relative to the striker mechanism 420 is manipulated by the offensive player using the joystick 412. The first linkage arm 438 is connected to a first linkage member 490 which extends from the first linkage arm 438 to the first end 462 of the ball trough 460. The first linkage member 490 extends across the bottom surface 32 and is preferably positioned underneath the ball trough 460. A pivot 439 is attached to the bottom surface 32 and serves as a pivot point for the first linkage member 490 for permitting the first linkage member 490 to move in up and down directions. When the joystick 412 is moved to the up position, the first linkage member 490 pivots about the pivot 439 and moves upwardly causing the ball trough 460 to also move upward. Similarly, when the joystick 412 is moved to the down position, the first linkage member 490 pivots about the pivot 439 and moves downwardly causing the ball trough 460 to move downward. Thus, it will be appreciated that the relative position between the ball trough 460 and the striker 478 is changed by manual manipulation of the joystick 412. For example, moving the ball trough 460 upward causes the striker 478 to strike a top portion of the ball 800. This creates top spin resulting in the ball 800 exiting the exit opening 402 at a higher rate of speed. Moving the ball trough 460 downward causes the striker 478 to strike a bottom portion of the ball 800. This creates back spin on the ball 800 and the ball 800 exits at a reduced rate of speed. Such pitch is known as a change-up pitch.

The position of the ball trough 460 relative to the striker mechanism 420 is also manipulated by moving the joystick 412 in the left and right directions. The second linkage arm 448 is connected to a pivotal member, generally indicated at 451, which includes a first leg 453 and a second leg 455. The first leg 453 is attached to the second linkage arm 448 and the second leg 455 is attached to the second linkage member 492 which extends from the second leg 455 to the first end 462 of the ball trough 460. The pivotal member 451 pivots about a point 457. The second linkage member 492 extends across the bottom surface 32 and preferably attaches to one of the side edges 461 of the ball trough 460. The manipulation of the second linkage member 492 causes the left and right movement of the ball trough 460. For example, the movement of the joystick 412 to the left position causes the second linkage arm 448 to move in the opposite right direction. The pivotal member 451 pivots about the point 457 and causes the second linkage member 492 to move in a first direction (toward the joystick 412). As a result, the first end 462 of the ball trough 460 moves toward the right causing the striker 478 to be aligned with a left portion of the ball 800 (shown in FIG. 15C). When the striker 478 strikes the ball 800 at a left portion thereof, a left handed spin is created. This results in the ball curving toward the first batter's box 140 after it exits the opening 402. Similarly, the movement of the joystick 412 to the right position causes the second linkage arm 448 to move in the opposite left direction and the second linkage arm 492 is displaced in a second opposite direction away from the joystick 412. As a result, the first end 462 of the ball trough 460 moves toward the left causing the striker 478 to be aligned with a right portion of the ball 800 (FIG. 15A). When the striker 478 strikes the ball 800 at a right portion thereof, a right handed spin is created. This results in the ball curving toward the second batter's box 142 after it exits the opening 402.

Figure 15B:
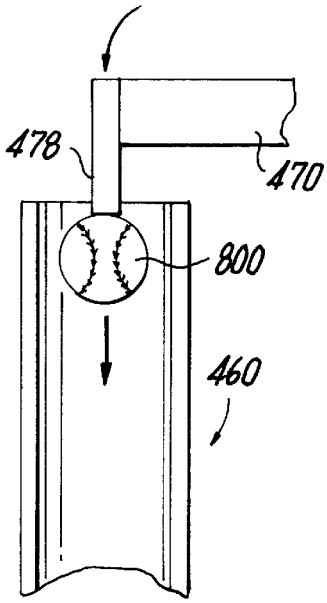
Figure 15C:
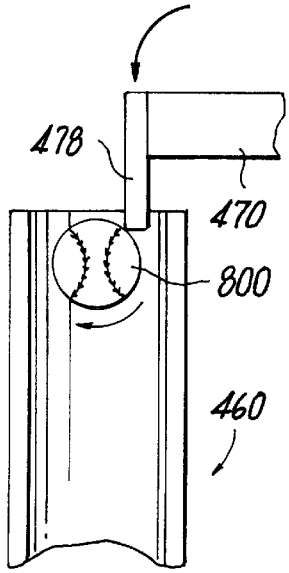

It will be understood that the defensive player may elect only to hit the ball squarely and thus only uses the striker mechanism 420 to deliver the pitch to the offensive player. As previously mentioned, if the joystick 412 is not moved, the ball trough 460 remains in a center position relative to the striker 478 as best shown in FIG. 15B. Therefore, after the plunger 422 is extended and then released, the striker 478 hits a center portion of the ball 800 and the ball is delivered to the home plate 402 without any spin being intentionally imparted on the ball 800. The pitching mechanism 400 thus represents a relatively simple mechanical mechanism which permits a level of pitching realism to be added to the play of the game apparatus 10. Because the defensive player can select from a number of pitches, the game simulates the game of baseball and permits each individual player to develop a pitching strategy depending upon the individual opponent.

It will also be appreciated that the general speed of the ball 800 may be controlled by how far the plunger 422 is pulled away from the housing 20. For example, if the plunger 422 is pulled only slightly away from the housing 20, the striker 478 will only be retracted a small distance from the first end 462 of the ball trough 460. This result in the striker 478 hitting the ball 800 at a reduced rate of speed when the plunger 422 is released. A slower pitch will therefore be delivered to the offensive player. In contrast, if the plunger 422 is pulled to the fully extended position, the striker 478 accelerates and strikes the ball 800 with a greater force. This results in the ball 800 being propelled through and exiting the opening 402 at a faster rate of speed.

Figure 17:
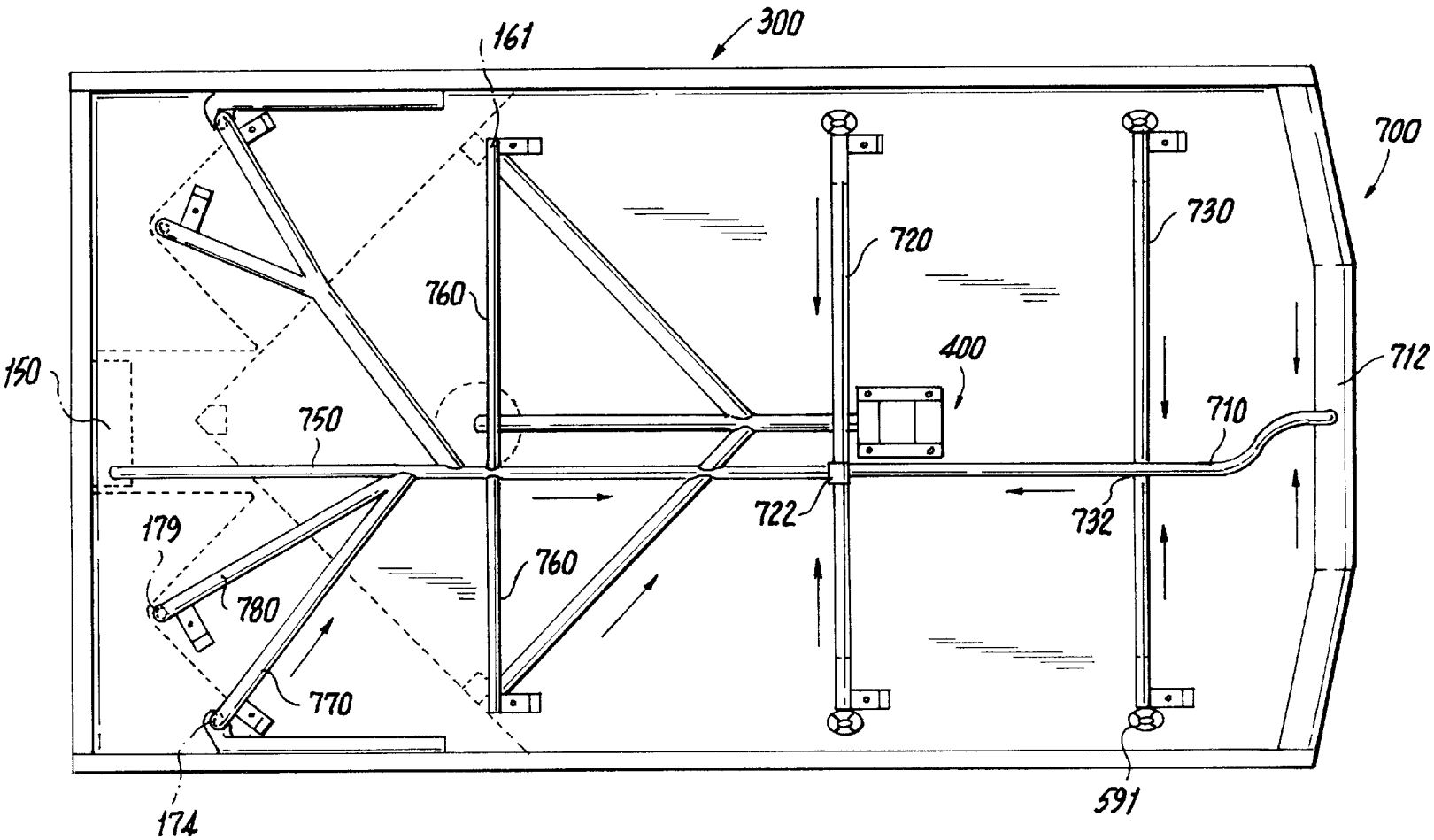
FIG. 17 is a plan view of one exemplary ball retrieval track system for use in the apparatus of FIG. 1.
Figure 18:
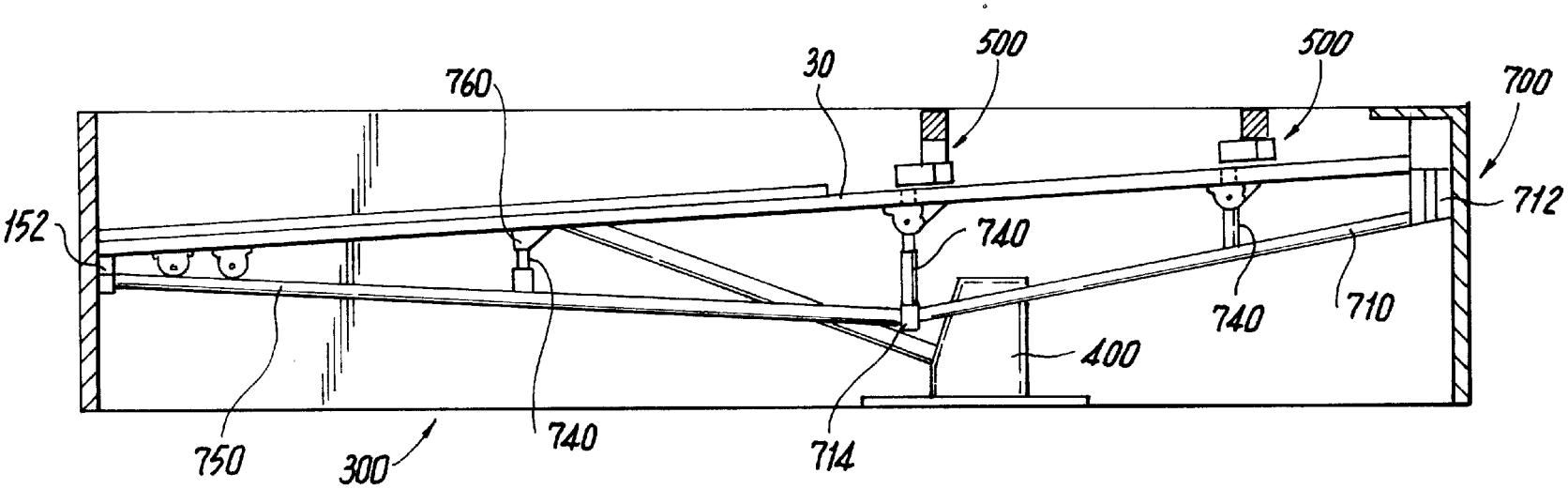
FIG. 18 is a side view of the ball retrieval track system of FIG. 17.

Now referring to FIGS. 17 and 18 in which the ball retrieval track system 300 is shown in greater detail. FIG. 17 is a plan view of the underside of the playing surface 29 and FIG. 18 is a side view of the ball retrieval track system 300. The ball retrieval track system 300 is designed to return the ball to the pitching mechanism 400 after the occurrence of an event. The ball retrieval track system 300 may be formed from a number of materials, including but not limited to wood, formed sheet metal, or plastic tubes. The exemplary ball retrieval track system 300 includes an opening formed at a predetermined location along the trough 700 to receive a ball which passes into the trough 700 after the occurrence of a scoring event. In the exemplary embodiment, the opening is formed in a central section of the trough 700. The trough 700 is thus formed with an inward slope so that the ball rolls toward the center and more specifically into the opening after the ball passes into the trough 700. The opening is in communication with a first ball retrieval member 710 which has a first end 712 which is connected to the opening and an opposing second end 714 which is connected to the pitching mechanism 400 so that once the ball drops through the opening, the ball rolls within the first retrieval member 710 and is delivered to the pitching mechanism 400 for delivery of the next pitch using the pitching mechanism 400. Preferably, the first retrieval member 710 comprises a tube-like structure having a diameter slightly larger than the diameter of the ball and in one exemplary embodiment, the first retrieval member 710 comprises a wire-formed tube.

Second and third ball retrieval members 720, 730, respectively, are provided to receive the ball once it falls through one of the out openings 591. The second retrieval member 520 extends between the two out openings 591 which are associated with the first movable member 510 and the third retrieval member 530 extends between the two out openings 591 which are associated with the second movable member 520. Each of the second and third retrieval members 720, 730 comprises an elongated tubular structure which sloped downward toward a center 722, 732, respectively, thereof. The center portion 722, 732 thus constitutes the lowest point of each of the members 720, 730 and the section in direct communication with one of the out openings 591 comprises the most elevated section. Therefore, when the ball falls within one of the out openings 591, the ball travels toward the center 722, 732 of the respective member 720 or 730. Each of the center portions 722, 732 is connected to the first retrieval member 710 by a connector 740.

The connector 740 also comprises a tube-like structure and is designed to receive the ball from one of the members 720, 730 and then deliver the ball into the first ball retrieval member 710 where it is delivered to the pitching mechanism 400. Because the playing surface 30 is sloped downward toward home plate 102, as best shown in the side view of FIG. 18, the length of the connector 740 for the first retrieval member 720 will be slightly longer than the length of the second retrieval member 730. As with the first retrieval member 710, the second and third retrieval members 720, 730 preferably comprise wire mesh tubes.

A fourth ball retrieval member 750 is used to deliver the ball from the catching mechanism 150 behind home plate 102 to the pitching mechanism 400. The fourth ball retrieval member 750 preferably includes one connector 740 which communicates with the opening 152 and delivers the ball to the fourth retrieval member 750. The ball then travels by gravity feed within the fourth retrieval member 750 to the pitching mechanism 400 where it is positioned so that the defensive player may pitch the ball. Preferably, the fourth retrieval member 750 comprises a wire-formed tube.

Depending upon the precise embodiment of the game apparatus 10, the ball retrieval track system 300 will vary. For example, the ball retrieval track system 300 shown in FIGS. 17 and 18 is merely exemplary in nature and one will understand that the ball retrieval track system 300 is designed so that each opening formed in the playing surface 30 is connected to a ball retrieval member which delivers the ball by gravity feed to the pitching mechanism 400. In the exemplary embodiment shown, the openings 161 formed in the playing surface 30 proximate to the first and third bases 104, 108 communicate with a fifth retrieval member 760 for delivering the ball to the pitching mechanism 400. As with the other retrieval members, the fifth retrieval member 760 slopes downward to a center portion thereof which communicates with the fourth retrieval member 750 by providing a connector 740 therebetween.

In the exemplary embodiment shown in FIGS. 17 and 18, which is based upon the embodiment of FIG. 4, a sixth ball retrieval member 770 extends from the foul ball opening 151 (FIG. 4) to the fourth retrieval member 750. The sixth ball retrieval member 770 also includes a sensor so that the device 50 is notified when a ball drops within one of the foul ball openings 151 and into the sixth ball retrieval member 770. Upon receipt of this signal, the device 50 will record a strike and in the case that the batter already has two strikes, an out is recorded. The ball is preferably delivered from the opening 151 to the fourth retrieval member 750 by gravity feed. A seventh ball retrieval member 780 is provided for linking the out opening 141 to the fourth retrieval member 750. A ball falling within the out opening 141 drops into one end of the seventh ball retrieval member 780 and is delivered to the other end which forms an entrance into the fourth retrieval member 750. A sensor is provided within the seventh ball retrieval member 780 which is designed to signal the device 50 when a ball is sensed. This signal to the device 50 instructs the device 50 to record another out and in the case that this is the third out, the inning is over the offensive player. As with the other retrieval members, the sixth and seventh retrieval members 770, 780 comprise wire mesh tubes. It will be understood that the sixth and seventh members 770, 780 may join one another to form a common member which communicates with the fourth retrieval member 750. This alternative configuration is shown in FIG. 17 for use with openings 141, 151 formed in the second section 162 (FIG. 4). It will be appreciated that the sixth and seventh members 770, 780 may remain separate from one another and simply communicate with the fourth retrieval member 750 at different locations.

The ball retrieval track system 300 thus comprises a gravity based mechanism in which the ball departs the playing surface 30 through one opening formed therein and then travels along a route defined by the ball retrieval track system 300 to the pitching mechanism 400. Preferably, the ball retrieval track system 300 is formed of wire-formed tubes; however, it will be understood that any number of other types of structures may be used. In addition, it will be appreciated that any number of sensors may be used and preferably, the sensors comprise contact sensors which generate signals upon contact with the ball.

Figure 19:
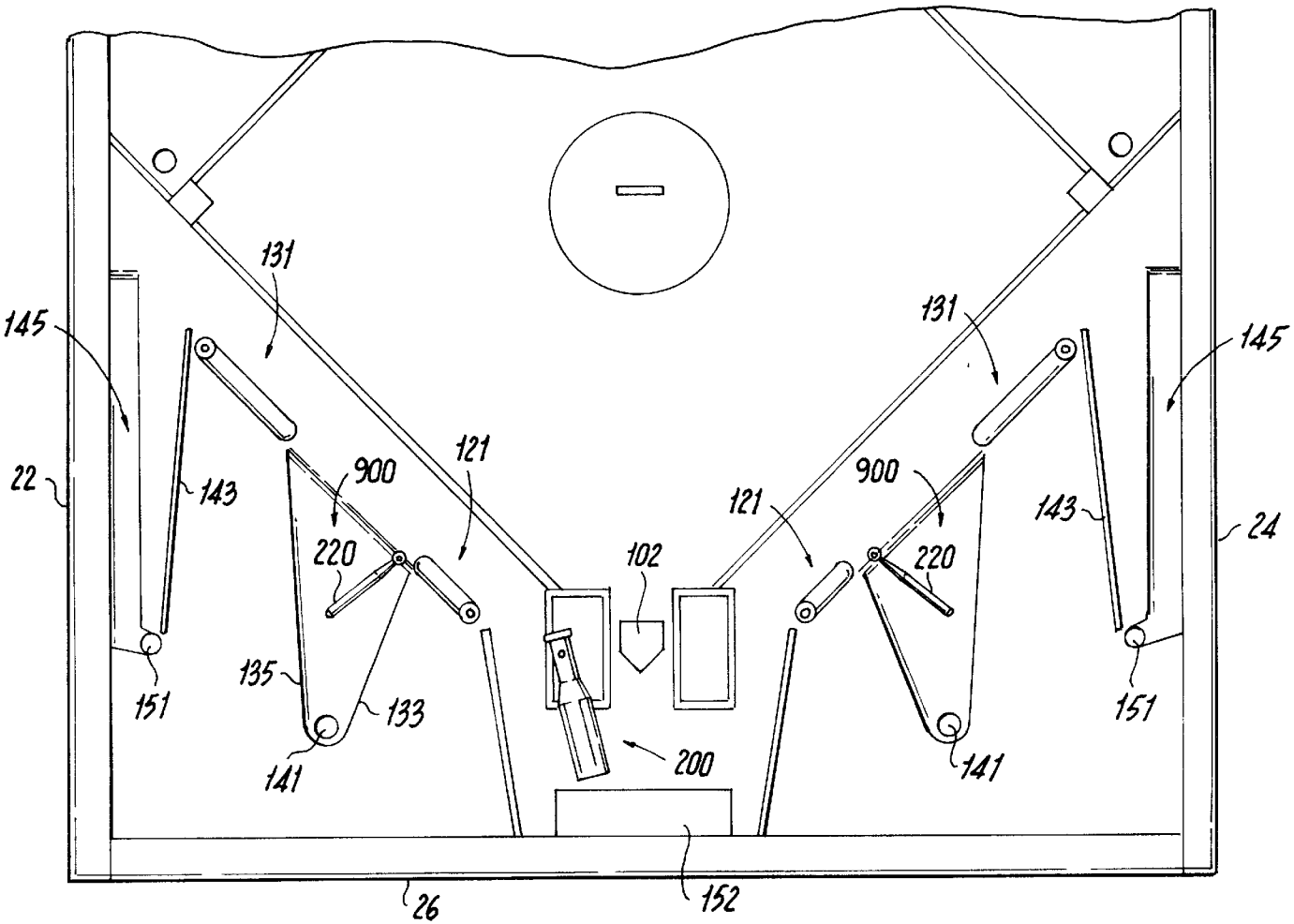
FIG. 19 is a top plan view of another exemplary playing surface.

Now referring to FIG. 19 in which yet another embodiment of the present invention is illustrated. This embodiment is similar to the embodiment shown in FIG. 4 in that first and second bumpers 121, 131 are provided. The one notable difference between the embodiments is that in this embodiment, a secondary batting mechanism 900 is provided to permit the offensive player to attempt to place the ball into fair play when the ball rolls off the infield 100 toward the out opening 141. The secondary bat mechanism 900 is disposed between the first and second bumpers 121, 131 and generally between the second and third fences 133, 135. As with the primary batting mechanism 200, the secondary batting mechanism 900 includes a batting arm 220 which is rotatable. Preferably, the secondary batting mechanism 900 is mechanically linked to the primary batting mechanism 200 so that manipulation of the primary batting mechanism 200 also causes manipulation of the secondary batting mechanism 900. In other words, when the offensive player rotates the handle 290 (FIG. 1), the batting arms 220 of each mechanism 200, 900 rotate to permit the player to attempt to make contact with the ball. In this embodiment, the offensive player may thus avoid an out by swinging the secondary batting mechanism 900 and hitting ball back into play.

The operation of the game apparatus 10 will now be further described with reference to FIGS. 1–18. As is known, the visiting team is the first team to bat in the baseball game. The visiting player thus assumes control of the batting mechanism 200 and stands behind the first end wall 22. The visiting offensive player places one or more hands on the handle 290 so that this player can swing the batting arm 210 in response to a pitch being delivered by the home defensive player. The goal of the offensive player is to successfully hit the ball 800 and record a base hit.

The home defensive player stands adjacent the first side wall 22 and uses the joystick mechanism 410 and the striker mechanism 420 to deliver the ball toward home plate 102. As the ball 800 is delivered to the batter, the batter swings the batting arm 210. Typically, as soon as the defensive player releases the striker mechanism 420, the player will then grip the handles 540 of the first and second movable members 510, 520 so as to be in a position to catch the ball in case contact is made and the ball is driven into the outfield 130. It will be appreciated that each pitch results in one event occurring and being recorded by the scoring device 50. For example, if the ball 800 is driven past the first and second movable members 510, 520 and strikes one of the indicators 610, then a hit or other event is achieved and recorded by the scoring device 50. If the ball is caught by the catching mechanism 500 or fails to clear the infield 100 and drops into one of the out openings 141, an out is recorded by the scoring device 50.

It will be understood that the play of the game apparatus 10 follows the traditional rules of baseball in that the offensive player continues to bat until three outs are recorded by the defensive player. Once three outs are recorded, the players switch positions and the game continues in this manner until a predetermined number of innings are completed. For optimum simulation, play will continue for nine innings with the game being over after the visiting team records three outs in the ninth inning if the home team has more runs at this point. If the home team trails after the visiting team completes their half of ninth inning, the home team bats in the ninth in an attempt to win the game. The game may also go into extra innings if the score is still tied after completion of nine innings.

While, the game apparatus 10 is suited for personal home entertainment, it is within the scope of the present invention that the game apparatus 10 may further include a coin mechanism (not shown) to receive payment in return for playing the game apparatus 10 either for a predetermined amount of time or a predetermined number of innings. In this instance, the game apparatus 10 finds particular utility as an arcade type game. For example, the coin mechanism may comprise any number of conventional designs and is typically linked to the pitching mechanism 400 so that the ball 800 is retained until a player deposits a sufficient number of coins having a predetermined value. Once, the requisite amount of money has been deposited, the coin mechanism releases the ball 800 to the pitching mechanism 400. At this point the game apparatus 10 is fully operational.

Because a nine inning game may take a substantial amount of time to complete, the coin mechanism may be designed so that the initial coin intake permits the players to play a limited number of innings. For example, depositing a predetermined number of coins permits the players to play three complete innings. If the players wish for the game to continue, the players will deposit additional coins. In this manner, nine complete innings may be played. Alternatively, depositing a predetermined number of coins will release the ball 800 and permit play for a predetermined amount of time. For example, depositing a predetermined number of coins grants the players 5 minutes in playing time and a clock (not shown) counts the time down so that the players may deposit additional money to continue play. If the players do not deposit additional money and the predetermined period of time expires, then next time the ball 800 falls within one of the openings formed in the playing field 29, the ball 800 is not delivered to the pitching mechanism 400 but rather is retained by the coin mechanism. At this point the game is over.

The present invention overcomes the deficiencies of the conventional game apparatus by providing a game which simulates the game of baseball and permits one player to simulate the pitching and fielding aspects of the game, while the other player simulates the batting aspects of the game.

While the invention has been particularly shown and described with reference to the preferred embodiments thereof, it will be understood by those skilled in the art that various changes in form and detail may be made therein without departing from the spirit and scope of the invention.

What is claimed is:

1. A baseball game apparatus comprising:

a housing having:

a playing field having an upper surface having indicia formed thereon representing a baseball field including a baseball diamond and an outfield;

a ball;

a pitching mechanism disposed within the housing for rolling the ball toward a hitting mechanism at home plate, the hitting mechanism for swinging at the ball;

a plurality of hit valuation indicators disposed across the playing field; and an adjustable fielding mechanism displaceable across the upper surface for recording an out after the ball has been hit using the hitting mechanism, the fielding mechanism including a gripable member disposed above the upper surface for moving relative positions of catching members for receiving and retaining the hit ball so an out may be recorded by positioning one of the catching members so that the hit ball travels into the one catching member causing the ball to be retained.

2. The baseball game apparatus of claim 1, wherein the housing is inclined so that a first end of the playing field including the outfield is elevated relative to a second end including home plate, the housing including a pair of opposing side walls and pair of opposing end walls with the playing field disposed therebetween.

3. The baseball game apparatus of claim 1, wherein the upper surface includes indicia representing a pitcher's mound with a ball opening being formed in the playing field at the pitcher's mound for rolling the ball from the pitching mechanism to home plate.

4. The baseball game apparatus of claim 1, further including a catching mechanism disposed behind home plate, the catching mechanism including an opening formed in the playing field for receiving a pitched ball that has passed over home plate.

5. The baseball game apparatus of claim 4, wherein the catching mechanism includes first and second spaced fences which aid in containing the ball within a batter's area and delivering the ball to the opening, the batter's area extending between a first batter's box and a second batter's box with home plate being formed therebetween.

6. The baseball game apparatus of claim 1, further including a scoring device for monitoring and displaying predetermined scoring-related information.

7. The baseball game apparatus of claim 6, wherein the scoring device comprises an electronic device which communicates with the plurality of hit valuation indicators to record and display the predetermined scoring-related information upon occurrence of an event.

8. The baseball game apparatus of claim 6, wherein the predetermined scoring-related information includes a home team score, a visitor team score, a number of outs, a number of strikes, a number of runners on base, and an inning number.

9. The baseball game apparatus of claim 1, wherein the hitting mechanism includes a rotatable batting arm disposed above the upper surface for contacting and hitting the rolled ball in response to manipulation of a batting handle, the rotatable batting arm being operatively connected to the batting handle by cam and pulley members.

10. The baseball game apparatus of claim 9, wherein the batting handle is attached to a handle shaft which connects to the cam member, the rotatable batting arm being attached to a batting arm shaft with the pulley member being disposed about the batting arm shaft such that a cable extends between the cam member and the pulley member and rotation of the cam member causes the cable to rotate the pulley resulting in the batting arm rotating.

11. The baseball game apparatus of claim 10, wherein the cable has a first end attached to the cam member and a second end attached to the pulley member, the cable being seated within a peripheral groove formed within the pulley.

12. The baseball game apparatus of claim 9, wherein the hitting mechanism further includes a second biasing member for returning the pulley member to an initial rest position after the batting arm is rotated by manipulating the handle which causes the second biasing member to extend, the second biasing member being attached at a first end to the pulley member and at a second end to a fixed member.

13. The baseball game apparatus of claim 12, wherein the second biasing element comprises a spring.

14. The baseball game apparatus of claim 1, wherein each opening formed in the playing field has a sensor associated therewith so that once the hit ball drops into one opening, a representative signal is generated and delivered to a scoring device, each of the plurality of hit valuation indicators also having a sensor associated therewith so that upon the hit ball contacting one of the indicators, a representative signal is generated and forwarded to the scoring device, each representative signal having a value associated therewith.

15. The baseball game apparatus of claim 14, wherein the value is elected from the group consisting of a hit, including a single, double, triple, and home run; an out; and a strike.

16. The baseball game apparatus of claim 1, wherein the plurality of hit valuation indicators includes regions on the upper surface designating selected hit results.

17. The baseball game apparatus of claim 16, wherein the plurality of hit valuation indicators comprises a predetermined number of pivotal panels extending across the outfield with a ball trough formed behind the pivotal panels for receiving and retaining the hit ball once it passes beneath one of the pivotal panels.

18. A baseball game apparatus comprising:

a housing having:

a playing field having an upper surface having indicia formed thereon representing a baseball field including a baseball diamond and an outfield, wherein an upper surface of the baseball diamond is elevated relative to surrounding sections of the upper surface of the playing field including the outfield;

a ball;

a pitching mechanism disposed within the housing for rolling the ball toward a hitting mechanism at home plate, the hitting mechanism for swinging at the ball;

a plurality of hit valuation indicators disposed across the playing field; and an adjustable fielding mechanism displaceable across the upper surface for recording an out after the ball has been hit using the hitting mechanism, the fielding mechanism including members for receiving and retaining the hit ball so an out may be recorded by positioning one of the members so that the hit ball travels into the one member causing the ball to be retained.

19. A baseball game apparatus comprising:

a housing having:

a playing field having an upper surface having indicia formed thereon representing a baseball field including a baseball diamond and an outfield;

a ball;

a pitching mechanism disposed within the housing for rolling the ball toward a hitting mechanism at home plate, the hitting mechanism for swinging at the ball, wherein the pitching mechanism includes a joystick mechanism for controlling the direction in which the ball is pitched and a striker mechanism for causing the ball to be delivered from the pitching mechanism toward home plate, the striker mechanism permitting the speed of a pitched ball to be variable;

a plurality of hit valuation indicators disposed across the playing field; and an adjustable fielding mechanism displaceable across the upper surface for recording an out after the ball has been hit using the hitting mechanism, the fielding mechanism including members for receiving and retaining the hit ball so an out may be recorded by positioning one of the members so that the hit ball travels into the one member causing the ball to be retained.

20. A baseball game apparatus comprising:

a housing having:

a playing field having an upper surface having indicia formed thereon representing a baseball field including a baseball diamond and an outfield;

a ball;

a pitching mechanism disposed within the housing for rolling the ball toward a hitting mechanism at home plate, the hitting mechanism for swinging at the ball, wherein the pitching mechanism includes a ball trough extending beneath the playing field from a first location to a ball trough extending beneath the playing field from a first location to a ball opening formed in the playing field at a pitcher's mound, the ball trough being inclined upwardly from the first location to the ball opening, actuation of the pitching mechanism causing the ball to travel within the ball trough to the ball opening where the ball exits onto the upper surface and rolls therealong toward home plate;

a plurality of hit valuation indicators disposed across the playing field; and an adjustable fielding mechanism displaceable across the upper surface for recording an out after the ball has been hit using the hitting mechanism, the fielding mechanism including members for receiving and retaining the hit ball so an out may be recorded by positioning one of the members so that the hit ball travels into the one member causing the ball to be retained.

21. The baseball game apparatus of claim 20, wherein the ball trough comprises a generally arcuate member.

22. The baseball game apparatus of claim 20, wherein the pitching mechanism includes a joystick mechanism for adjusting the ball trough at the first location in such a way as to control the direction in which the ball is pitched and a striker mechanism for accelerating the ball from the first location along the ball rough to the ball opening.

23. The baseball game apparatus of claim 22, wherein the striker mechanism includes a striker plunger operatively connected to a pivotal striker which contacts and drives the ball upon actuation of the striker plunger.

24. The baseball game apparatus of claim 23, wherein the end of the ball trough at the first location is disposed adjacent the pivotal striker so that the striker pivots and contacts and drives the ball disposed in the end of the ball trough upon actuation.

25. The baseball game apparatus of claim 23, wherein a portion of the striker plunger is in the form of a handle which may be grasped by the player, the striker plunger being connected to the pivotal striker by a first member for causing the striker to pivot in a first direction upon extension of the striker plunger, the striker being further connected to a first biasing member which urges the striker to pivot in an opposite second direction once the striker plunger is released, whereby the striker contacts and drives the ball.

26. The baseball game apparatus of claim 25, wherein the first member is a cable and the first biasing member is a spring.

27. The baseball game apparatus of claim 22, wherein the joystick mechanism includes a joystick which may be grasped and is operatively connected to a first linkage assembly which controls up and down movement of the ball trough and a second linkage assembly which controls left and right movement of the ball trough.

28. The baseball game apparatus of claim 27, wherein the first linkage assembly includes a first linkage plate having a slot formed therein which receives a shaft of the joystick, a first linkage arm extending from the first linkage plate and being connected to a first pivotal linkage member which is connected to the one end of the ball trough and pivots for causing the up and down movement of the ball trough in response to manipulation of the joystick.

29. The baseball game apparatus of claim 27, wherein the second linkage assembly includes a second linkage plate having a slot formed therein which receives a shaft of the joystick, a second linkage arm extending from the second linkage plate and being operatively connected to a second linkage member which causes the ball trough to move laterally in response to manipulation of the joystick.

30. The baseball game apparatus of claim 29, wherein the second linkage arm is operatively connected to the second linkage member using a pivotal member having a first leg connected to the second linkage arm and a second leg connected to the second linkage member, wherein movement of the joystick in a left direction causes the pivotal member to pivot in a first direction for moving the ball trough in a first direction and movement of the joystick in a right direction causes the pivotal member to pivot in an opposite second direction for moving the ball trough in an opposite second direction, the movement of the ball trough in one of the first and second directions results in the relative position between the ball trough and the striker mechanism being changed which causes spin to be imparted to the ball upon actuation of the striker mechanism.

31. The baseball game apparatus of claim 29, wherein the second linkage member is attached to one side wall of the ball trough.

32. A baseball game apparatus comprising:

a housing having:

a playing field having an upper surface having indicia formed thereon representing a baseball field including a baseball diamond and an outfield;

a ball;

a pitching mechanism disposed within the housing for rolling the ball toward a hitting mechanism at home plate, the hitting mechanism for swinging at the ball;

a plurality of hit valuation indicators disposed across the playing field; and an adjustable fielding mechanism displaceable across the upper surface for recording an out after the ball has been hit using the hitting mechanism, the fielding mechanism including members for receiving and retaining the hit ball so an out may be recorded by positioning one of the members so that the hit ball travels into the one member causing the ball to be retained, wherein the fielding mechanism includes first and second movable members which each includes one or more glove assemblies for catching and retaining the hit ball so that an out may be recorded.

33. The baseball game apparatus of claim 32, wherein each of the first and second movable members has a support member extending laterally across the upper surface between side walls of a housing, the support member having a central opening formed therethrough for receiving a rod, the rod having a handle at one end for a player to grasp with the rod being slidingly displaced within the support member in response to extension and retraction of the rod using the handle.

34. The baseball game apparatus of claim 33, wherein each glove assembly is attached to one of the first and second movable members using a slidable block which is received within the opening formed in the support member, the slidable block itself having an opening formed therethrough for receiving the rod, wherein the slidable block is fixedly attached to the rod so that lateral movement of the rod results in each glove assembly lateral moving across the upper surface.

35. The baseball game apparatus of claim 32, wherein each glove assembly includes a base member and a gate structure operatively connected thereto, the base member having an opening formed therein for receiving the hit ball which swings the gate structure open to gain access into a compartment defined by the base member, the hit ball being retained within the compartment once the gate structure closes.

36. The baseball game apparatus of claim 32, wherein the playing field includes a plurality of out openings formed therein, the out openings being axially aligned with one of the first and second movable members so that once the hit ball is retained within one of the glove assemblies, the respective movable member is adjusted so that the one glove assembly is disposed over the one out opening and the ball falls therein to record the out.

37. The baseball game apparatus of claim 32, wherein the first and second movable members extend laterally across the outfield.

38. A baseball game apparatus comprising:

a housing having:

a playing field having an upper surface having indicia formed thereon representing a baseball field including a baseball diamond and an outfield;

a ball;

a pitching mechanism disposed within the housing for rolling the ball toward a hitting mechanism at home plate, the hitting mechanism for swinging at the ball;

a plurality of hit valuation indicators disposed across the playing field;

an adjustable fielding mechanism displaceable across the upper surface for recording an out after the ball has been hit using the hitting mechanism, the fielding mechanism including members for receiving and retaining the hit ball so an out may be recorded by positioning one of the members so that the hit ball travels into the one member causing the ball to be retained; and a ball retrieval track system for returning the ball to the pitching mechanism after the ball has been pitched, wherein the ball retrieval track system comprises a number of ball carrying members each of which communicates with one or more openings formed in the playing field, each of the ball carrying members being disposed at an angle so that the pitched ball is returned to the pitching mechanism by gravity.

39. A baseball game apparatus comprising:

a housing having:

a playing field having an upper surface having indicia formed thereon representing a baseball field including a baseball diamond and an outfield, wherein an upper surface of the baseball diamond is elevated relative to surrounding sections of the upper surface of the playing field including the outfield;

a ball;

a first control system disposed within the housing at home plate for swinging at the ball;

a second control system disposed within the housing for rolling the ball toward the first control system at home plate and fielding the ball after it has been hit, the second control system including an adjustable fielding mechanism which is laterally displaceable across the upper surface of the playing field for catching the hit ball and recording an out by manipulating the fielding mechanism so that the ball drops within one out opening formed in the playing field; and a plurality of scoring valuation indicators disposed across the playing field, each scoring valuation indicator designating a selected baseball event.

* * * * *

UNITED STATES PATENT AND TRADEMARK OFFICE

CERTIFICATE OF CORRECTION

PATENT NO. : 6,533,272 B2
DATED : March 18, 2003
INVENTOR(S) : Peter Hylak et al.

It is certified that error appears in the above-identified patent and that said Letters Patent is hereby corrected as shown below:

Title page,
Item [75], Inventors, delete "Lyle Williman" and substitute with -- Lyle Willimann --

Signed and Sealed this

Twenty-ninth Day of July, 2003

JAMES E. ROGAN
*Director of the United States Patent and Trademark Office*